US009287621B2

(12) United States Patent
Shimura

(10) Patent No.: US 9,287,621 B2
(45) Date of Patent: Mar. 15, 2016

(54) MULTI-BAND ANTENNA

(71) Applicant: CANON KABUSHIKI KAISHA, Tokyo (JP)

(72) Inventor: Hajime Shimura, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 266 days.

(21) Appl. No.: 13/951,815

(22) Filed: Jul. 26, 2013

(65) Prior Publication Data

US 2014/0043198 A1 Feb. 13, 2014

(30) Foreign Application Priority Data

Aug. 8, 2012 (JP) ..... 2012-176372
May 17, 2013 (JP) ..... 2013-105627

(51) Int. Cl.

| | |
|---|---|
| ***H01Q 1/24*** | (2006.01) |
| ***H01Q 5/00*** | (2015.01) |
| ***H01Q 9/04*** | (2006.01) |
| ***H01Q 9/06*** | (2006.01) |
| ***H01Q 5/307*** | (2015.01) |
| ***H01Q 5/371*** | (2015.01) |

(52) U.S. Cl.

CPC ..... *H01Q 5/0027* (2013.01); *H01Q 1/243* (2013.01); *H01Q 5/307* (2015.01); *H01Q 5/371* (2015.01); *H01Q 9/0407* (2013.01); *H01Q 9/065* (2013.01)

(58) Field of Classification Search

CPC ..... H01Q 1/243; H01Q 9/0407; H01Q 5/371; H01Q 5/0027; H01Q 5/307; H01Q 9/065

USPC ..... 343/702, 700 MS, 846

See application file for complete search history.

(56) References Cited

U.S. PATENT DOCUMENTS 6,459,413 B1 10/2002 Tseng et al.
6,535,170 B2 * 3/2003 Sawamura et al. ..... 343/702

(Continued)

FOREIGN PATENT DOCUMENTS

CN 10-1283479 A 10/2008
FR 2821985 A 9/2002

(Continued)

OTHER PUBLICATIONS

Rod Waterhouse, ed., "Printed Antennas for Wireless Communications", Wiley, ISBN 978-0-470-51069-8, pp. 257-279 (2007).

(Continued)

*Primary Examiner* — Hoanganh Le

(74) *Attorney, Agent, or Firm* — Fitzpatrick, Cella, Harper & Scinto

(57) ABSTRACT

An antenna which operates in a plurality of frequency bands includes a feeding point, a first conductor which is connected to the feeding point, and at least two second conductors which are branched from the first conductor, have a linear shape, and include open ends as ends on a side opposite to the first conductor. The open ends of the two second conductors face in almost the same direction substantially parallel to a side closest to the feeding point out of the sides of an antenna region. The two second conductors include a part at which the distance between the two conductors at a portion parallel to the side is a first distance, and another part at which the distance is a second distance shorter than the first distance, and are electromagnetically coupled at, at least the other part.

13 Claims, 17 Drawing Sheets

(56) References Cited

U.S. PATENT DOCUMENTS

| | | | | |
|---|---|---|---|---|
| 6,611,235 | B2 | 8/2003 | Barna et al. | |
| 7,081,857 | B2 * | 7/2006 | Kinnunen et al. | 343/702 |
| 7,903,035 | B2 | 3/2011 | Mikkola et al. | |
| 8,175,067 | B2 | 5/2012 | Shimura | |
| 8,547,947 | B2 | 10/2013 | Shimura | |
| 2002/0089453 | A1 | 7/2002 | Tseng et al. | |
| 2002/0154066 | A1 | 10/2002 | Barna et al. | |
| 2004/0130493 | A1 * | 7/2004 | Horita et al. | 343/702 |
| 2006/0114159 | A1 * | 6/2006 | Yoshikawa et al. | 343/702 |
| 2007/0109202 | A1 * | 5/2007 | Vance | 343/702 |
| 2007/0115188 | A1 | 5/2007 | Mizoguchi et al. | |
| 2007/0268190 | A1 * | 11/2007 | Huynh | 343/702 |
| 2008/0074332 | A1 | 3/2008 | Arronte et al. | |
| 2008/0266182 | A1 | 10/2008 | Teshima | |
| 2010/0135228 | A1 | 6/2010 | Shimura | |
| 2012/0007782 | A1 | 1/2012 | Nishio et al. | |
| 2013/0201871 | A1 | 8/2013 | Shimura | |

FOREIGN PATENT DOCUMENTS

| | | | |
|---|---|---|---|
| JP | 4457850 | B | 4/2010 |
| JP | 4710457 | B | 6/2011 |
| WO | 2007/042614 | A | 4/2007 |

OTHER PUBLICATIONS

European Search Report dated Dec. 16, 2013 from corresponding European Appln. No. 13177406.9.

Chinese Office Action dated Feb. 2, 2015 for counterpart Chinese Patent Application No. 201310336942.2.

* cited by examiner

MULTI-BAND ANTENNA

BACKGROUND OF THE INVENTION

1. Field of the Invention

The present invention relates to a multi-band antenna.

2. Description of the Related Art

Recently, a wireless communication function is mounted in various electronic devices. Also, there are proposed an increasing number of devices in which one electronic device complies with a plurality of wireless communication standards. These devices need to implement an antenna which operates in a plurality of frequency bands corresponding to the respective standards. Along with downsizing of devices, the antenna which operates in a plurality of frequency bands needs to be arranged in a space as small as possible. To achieve this, one antenna needs to have a plurality of operating bands and have a desired antenna operating bandwidth.

For example, Japanese Patent No. 4710457 proposes a method of configuring a dual-band antenna which operates in two frequency bands by adding a parasitic element. Also, for example, Japanese Patent No. 4457850 or Rod Waterhouse, "Printed Antennas for Wireless Communications", WILEY, 2007, ISBN 978-0-470-51069-8, pp. 257-279 proposes the arrangement of an antenna having a wideband antenna characteristic as a dual-band antenna or multi-band antenna.

In general, an electronic device needs to be small, so an antenna serving as a component of the electronic device also needs to be small. Since laws concerning wireless communication differ between countries, frequencies used in the respective countries are different even for the same wireless communication standard. On the assumption that electronic devices sell in all the world's countries, an antenna which achieves a very wide operating bandwidth of about 5 GHz to 6 GHz in, for example, the 5-GHz band in a wireless LAN is requested to cope with major countries. However, a conventional antenna does not fully satisfy requirements that it is compact, operates in a plurality of frequency bands, and operates in a wide band depending on the wireless standard.

The present invention provides a compact multi-band antenna capable of easily satisfying the operating frequency requirement.

SUMMARY OF THE INVENTION

According to one aspect of the present invention, there is provided a multi-band antenna which operates in a plurality of frequency bands, comprising: a feeding point; a first conductor which is connected to the feeding point; and at least two second conductors which are branched from the first conductor, have a linear shape, and include open ends as ends on a side opposite to the first conductor, wherein the open ends of the two second conductors face in substantially the same direction substantially parallel to a side closest to the feeding point out of sides of a region where the antenna is formed, the two second conductors include a part at which a distance between the two conductors at a portion parallel to the side is a first distance, and another part at which the distance is a second distance shorter than the first distance, and the two second conductors are electromagnetically coupled at, at least the other part.

Further features of the present invention will become apparent from the following description of exemplary embodiments with reference to the attached drawings.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

<<First Embodiment>>

The first embodiment will describe an antenna used in a wireless communication function complying with wireless LAN (IEEE802.11a/b/g/n) standards. Coping with all IEEE802.11a/b/g/n requires a dual-band antenna which operates in both the 2.4-GHz and 5-GHz frequency bands. As described above, an antenna to be assembled in the body of an electronic device needs to be small. When assembling the wireless communication function in an electronic device, it is general to ensure an antenna region by removing a conductor from each layer of a wireless module substrate, and print and implement a pattern antenna in the antenna region. If an object exists near the antenna, it blocks emission of an electromagnetic wave. To prevent the presence of an object around the antenna as much as possible, the antenna to be assembled in the electronic device needs to be implemented to project from a peripheral object. However, it is important to shorten the projection in terms of the convenience of the user who uses the electronic device.

Figure 1:
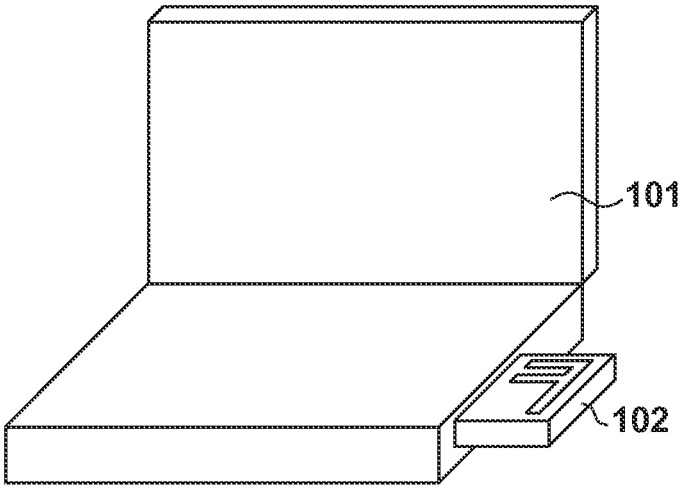
FIG. 1 is a view showing a state in which a wireless LAN card is inserted in the card slot of a notebook PC.

FIG. 1 is a view showing a state in which a wireless LAN card 102 having the wireless LAN communication function is inserted in the card slot of a notebook PC 101. In this case, if an antenna implemented in the wireless LAN card enters the notebook PC 101, emission of an electromagnetic wave from the antenna is blocked. To prevent this, the antenna implementation portion of the wireless LAN card 102 stays outside the notebook PC 101 in FIG. 1. However, the projection of antenna may catch the user during some kind of work. Hence, the antenna implemented in the wireless LAN card 102 needs to have a low profile, that is, have a shape in which the short side of an area where the antenna is formed is much shorter than its long side, and to minimize the antenna projection outside the notebook PC 101.

In this manner, the antenna to be assembled in the electronic device sometimes needs to have a low-profile shape in which one side of the antenna region is greatly short. Since an area applied for a compact antenna is small, it is important to ensure a high degree of design freedom. Therefore, an embodiment of a compact, low-profile dual-band antenna with a high degree of design freedom which is formed by a pattern on a module substrate (on a flat surface) will be explained.

(Antenna Structure)

Figure 2:
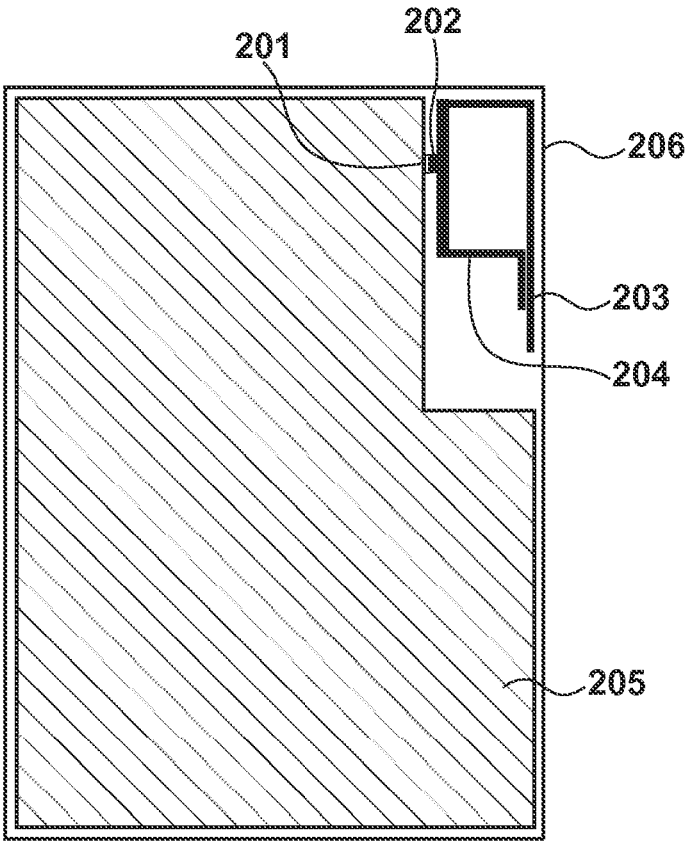
FIG. 2 is a front view showing the structure of a dual-band antenna.

FIG. 2 is a front view exemplifying the structure of a dual-band antenna according to the first embodiment. The dual-band antenna according to the first embodiment is formed from a feeding point 201, a first conductor 202, and two second conductors 203 and 204 branched from the first conductor. The dual-band antenna includes antenna ground 205. For simplicity, when the first conductor 202 and the second conductors 203 and 204 need not be particularly discriminated, they will be simply called "conductors". In FIG. 2, black portions represent the first conductor 202 and the second conductors 203 and 204. A hatched portion represents the antenna ground 205 formed from a conductor. In practice, various components for implementing the wireless function are implemented on the antenna ground 205, but are not taken into consideration in the embodiment. The two second conductors 203 and 204 have a linear shape, and have open ends as ends on an opposite side on which the second conductors 203 and 204 are not connected to the first conductor 202. The two second conductors 203 and 204 are close to each other near their open ends and are coupled. The "coupling" refers to electromagnetic coupling that includes electrostatic coupling (capacitive coupling), magnetic coupling (inductive coupling), and electric/magnetic coupling in which both of them coexist. Note that the first conductor 202 and the second conductors 203 and 204 are actually formed by a pattern on the flat surface of a substrate, and when observed in detail, have a thin-plate like shape. In this specification and claims, such a shape is also expressed as "linear shape".

Resists (protective surface films of an insulator) are formed on the respective conductors and antenna ground of the dual-band antenna. In the embodiment, part of the antenna ground 205 is formed at a predetermined distance at a position where it faces the open ends of the two second conductors 203 and 204. The antenna ground 205 is arranged so that the distance between at least one of the open ends of the second conductors 203 and 204 and the antenna ground 205 (shortest distance between the open end and the region of the antenna ground 205) becomes equal to or smaller than a predetermined length. This setting can improve the characteristic of the dual-band antenna in FIG. 2. For example, the distance between the open end of the second conductor 203 (and 204) and the antenna ground 205 is set to be equal to or smaller than a predetermined length. In this case, the reflection coefficient when power is supplied from the feeding point 201 can be decreased, and the operating frequency bandwidth can be increased, compared to a case in which the antenna ground 205 does not exist in this range. The antenna ground 205 is arranged at a position where it faces the open ends of the two second conductors 203 and 204 in the embodiment, but is not limited to this. On the condition that the shortest distance between the open ends of the second conductors 203 and 204 and the region occupied by the antenna ground 205 becomes equal to or smaller than a predetermined length, the antenna ground 205 may not be arranged at the position where it faces the open ends.

Each conductor is formed by a pattern on the flat surface of a dielectric substrate (FR4 substrate) 206. The relative dielectric constant of the dielectric substrate (FR4 substrate) 206 is, for example, 4.2. A portion on the dielectric substrate (FR4 substrate) 206 where the antenna ground 205 does not exist is the antenna region. In FIG. 2, the dimensions of the antenna region are 15 mm×5.5 mm. The thickness of the substrate including all the dielectric substrate, conductor, and resist is 0.878 mm. As a pattern antenna for the 2.4-GHz and 5-GHz bands used in IEEE802.11a/b/g/n, these dimensions of the antenna region are small, compared to a conventional technique. The antenna region is a low-profile rectangle having a short side much shorter than a long side.

Figure 3:
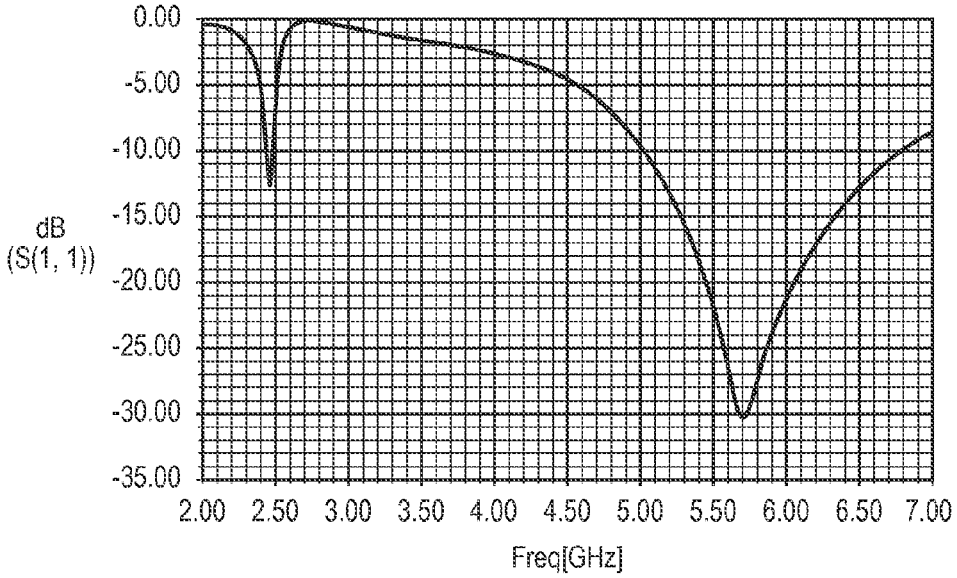
FIG. 3 is a graph showing the simulation result of the reflection characteristic (S11) of the dual-band antenna in FIG. 2.

FIG. 3 is a graph showing the simulation result of the reflection characteristic (S11 ) of the dual-band antenna shown in FIG. 2. As is apparent from FIG. 3, satisfactory reflection characteristics are obtained in both the 2.4-GHz and 5-GHz frequency bands used in IEEE802.11a/b/g/n, and the dual-band antenna operates as an antenna in these bands.

As for the 2.4-GHz band, the bandwidth at which the reflection characteristic is equal to or lower than −6 dB is about 100 MHz. Since the bandwidth necessary for the wireless LAN is about 70 MHz, an operating bandwidth requested of the wireless LAN can be ensured. In the 5-GHz band, a wide operating bandwidth (about 1 GHz) is requested for the wireless LAN. To meet this request, the bandwidth at which the reflection characteristic is equal to or lower than −10 dB is about 1.8 GHz in the dual-band antenna according to the embodiment. This reveals that the dual-band antenna according to the embodiment can ensure a much wider operating bandwidth than the operating bandwidth requested of the wireless LAN.

(Antenna Operation)

Next, the operation of the dual-band antenna according to the embodiment will be explained.

(Roles of Respective Conductors)

Figure 4:
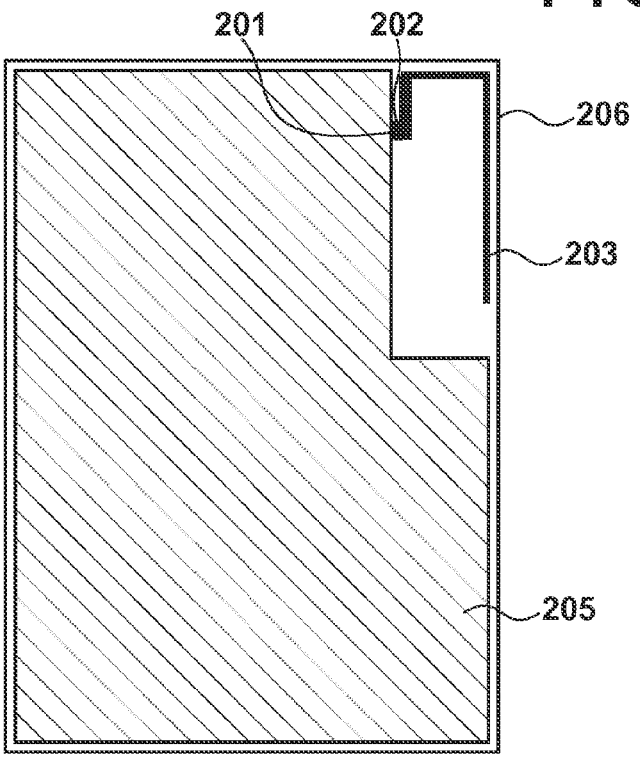
FIG. 4 is a front view showing an antenna structure formed from a feeding point 201, conductor 202, conductor 203, antenna ground 205, and dielectric substrate (FR4 substrate) 206.
Figure 5:
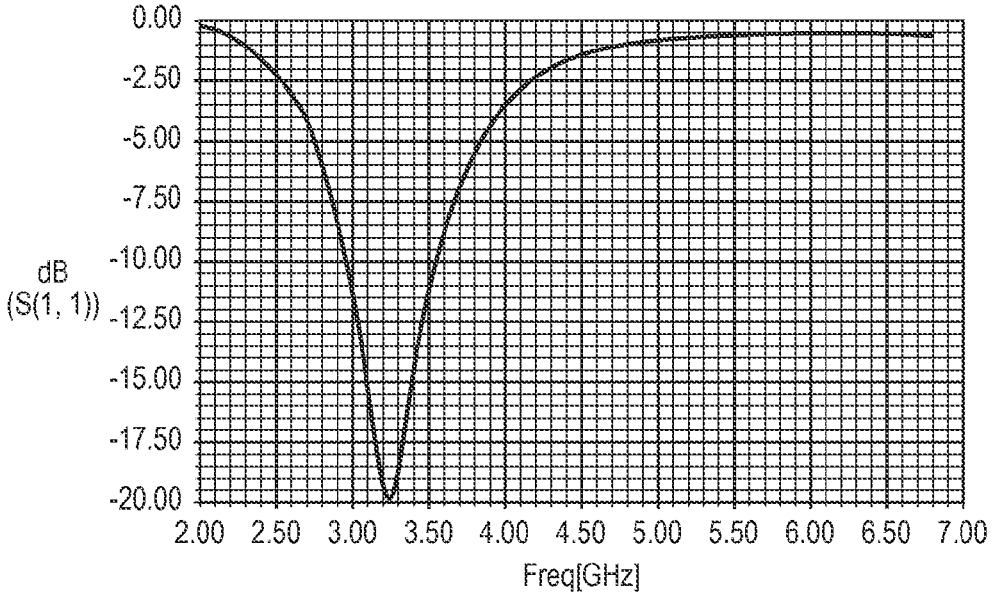
FIG. 5 is a graph showing the simulation result of the reflection characteristic (S11) of the antenna in FIG. 4.
Figure 6:
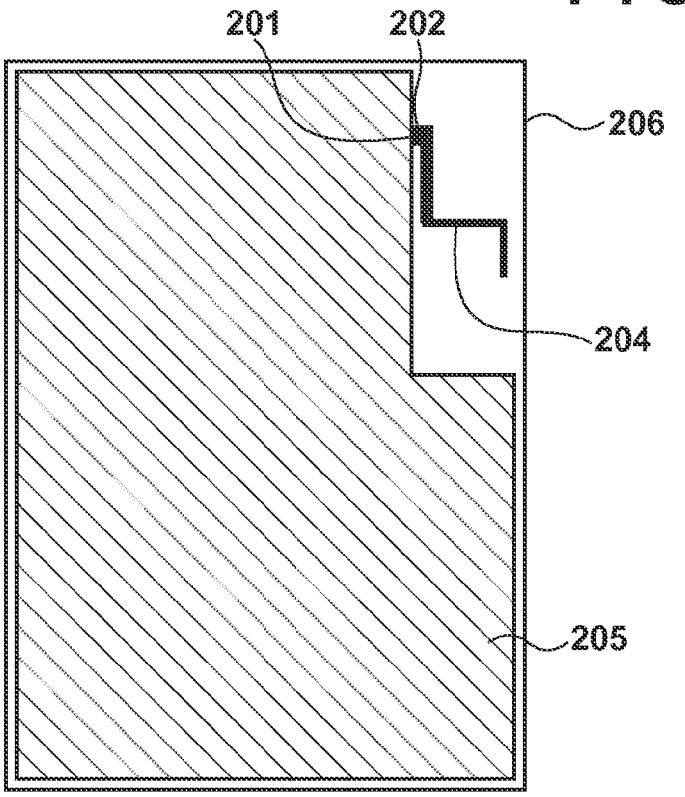
FIG. 6 is a front view showing an antenna structure formed from the feeding point 201, the conductor 202, a conductor 204, the antenna ground 205, and the dielectric substrate (FR4 substrate) 206.
Figure 7:
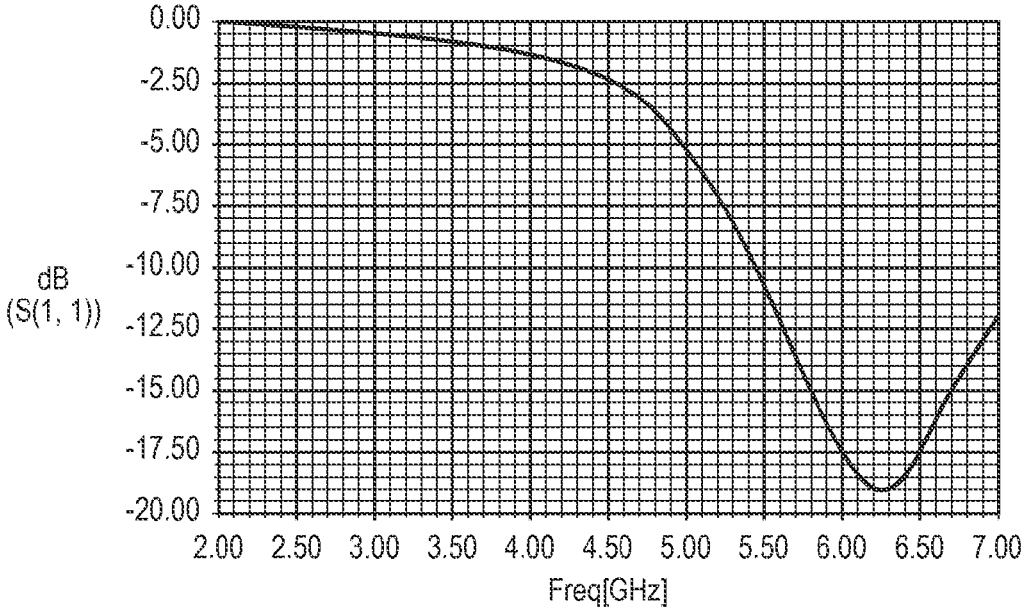
FIG. 7 is a graph showing the simulation result of the reflection characteristic (S11) of the antenna in FIG. 6.

First, the role of the first conductor 202, and those of the two second conductors 203 and 204 branched from the first conductor 202 will be explained. The behavior of the antenna according to the embodiment in a structure which does not include either the second conductor 203 or 204 will be described. A structure which does not include the conductor 204 is an antenna formed from the feeding point 201, conductors 202 and 203, antenna ground 205, and dielectric substrate (FR4 substrate) 206, as shown in FIG. 4. FIG. 5 shows the simulation result of the reflection characteristic (S11), and the resonance frequency is about 3.25 GHz. A structure which does not include the conductor 203 is an antenna formed from the feeding point 201, conductors 202 and 204, antenna ground 205, and dielectric substrate (FR4 substrate) 206, as shown in FIG. 6. FIG. 7 shows the simulation result of the reflection characteristic (S11), and the resonance frequency is about 6.25 GHz. From this, the path extending from the conductor 202 to the conductor 203 mainly contributes to an antenna characteristic on the low frequency side in the dual-band antenna shown in FIG. 2. Also, the path extending from the conductor 202 to the conductor 204 mainly contributes to an antenna characteristic on the high frequency side.

(Distance Between Conductors and Antenna Characteristic)

Figure 8:
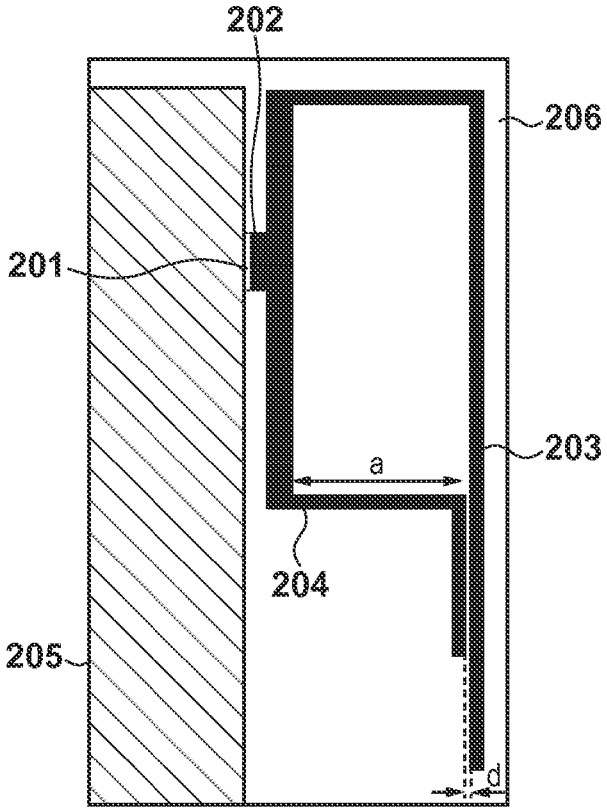
FIG. 8 is a view for explaining the distance between the two conductors of the dual-band antenna.
Figure 9A:
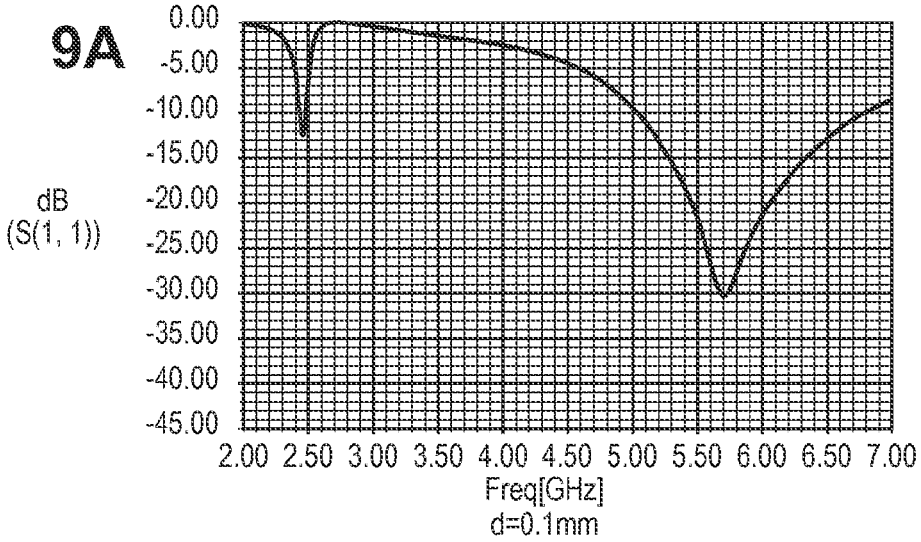
FIGS. 9A to 9C are graphs showing the simulation results of the reflection characteristic (S11) of the dual-band antenna when the distance between the conductors is changed.
Figure 9B:
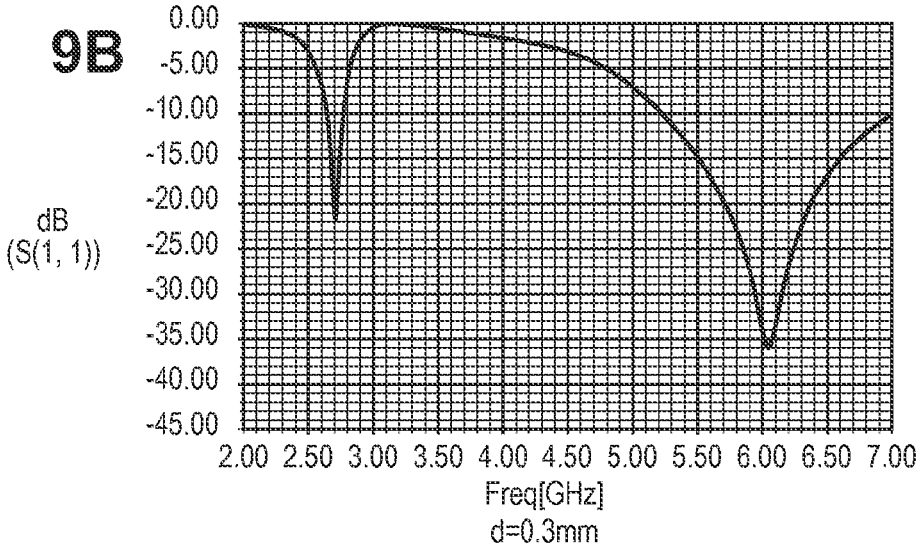
Figure 9C:
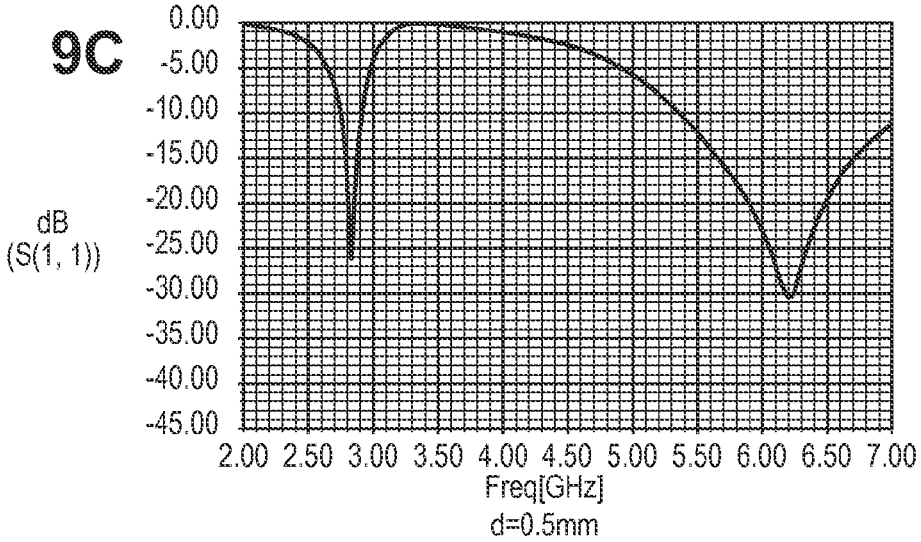

The relationship between the distance between the conductors 203 and 204 and a change of the antenna characteristic will be explained. FIGS. 9A to 9C show the simulation results of the reflection characteristic when a length a of the conductor 204 contributing to the antenna characteristic on the high frequency side is changed to change a distance d between the conductors 203 and 204 in the dual-band antenna, as shown in FIG. 8.

The simulation results in FIGS. 9A to 9C indicate that the resonance frequencies on the high and low frequency sides shift to be lower as the distance d becomes shorter. Thus, as the distance d between the conductors 203 and 204 becomes shorter, coupling between them becomes stronger, and the resonance frequencies on the high and low frequency sides can be shifted to be lower. In this case, when attention is focused on the characteristic in the 2.4-GHz band in FIGS. 9A to 9C, the antenna operating bandwidth becomes narrower as the distance d between the conductors 203 and 204 becomes shorter. Note that the distance d of the dual-band antenna in FIG. 2 is 0.1 mm.

(Coupling Position and Antenna Characteristic)

Next, the relationship between the coupling position where the conductors 203 and 204 are coupled, and a change of the antenna characteristic will be explained.

Figure 10:
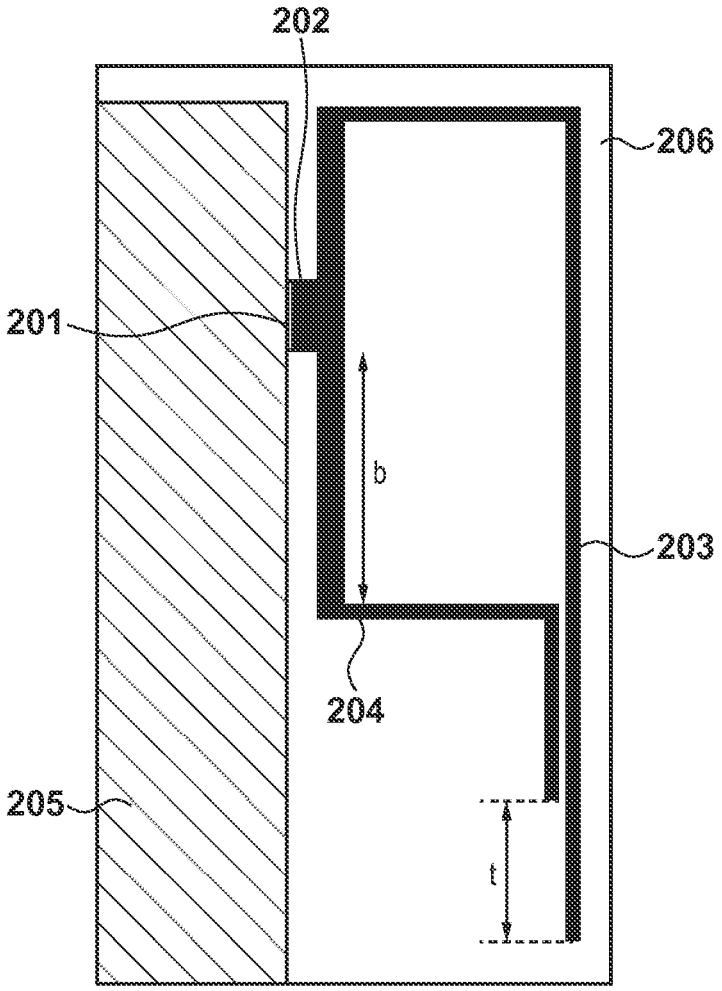
FIG. 10 is a view for explaining the coupling position of the two conductors of the dual-band antenna.
Figure 11A:
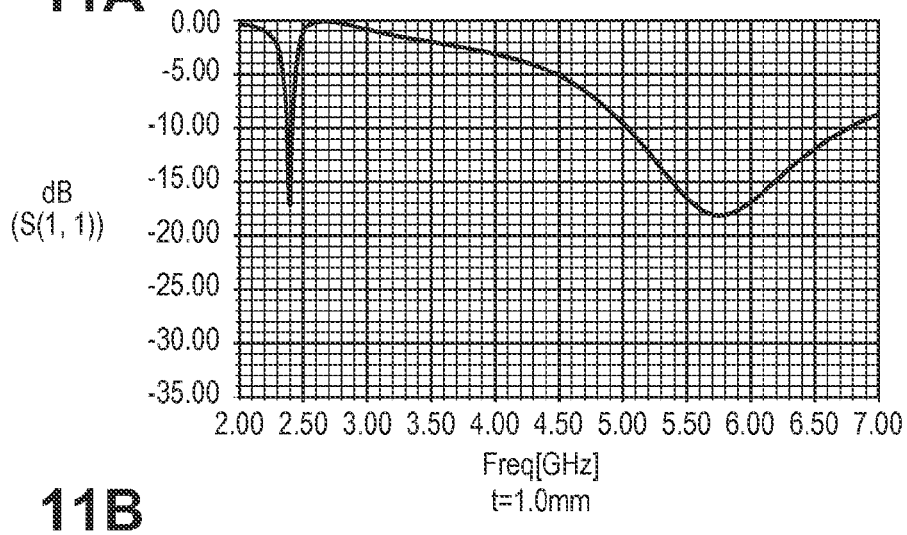
FIGS. 11A to 11C are graphs showing the simulation results of the reflection characteristic (S11) of the dual-band antenna when the coupling position is changed.
Figure 11B:
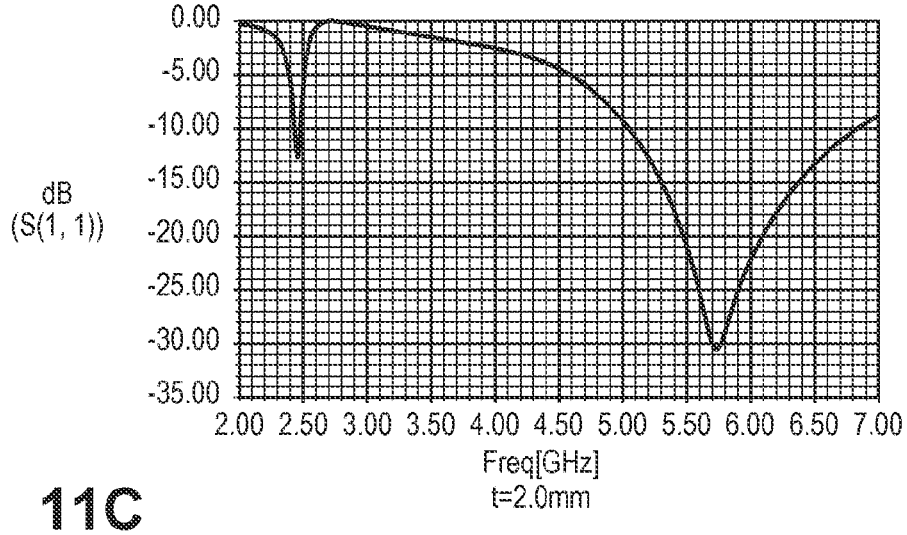
Figure 11C:
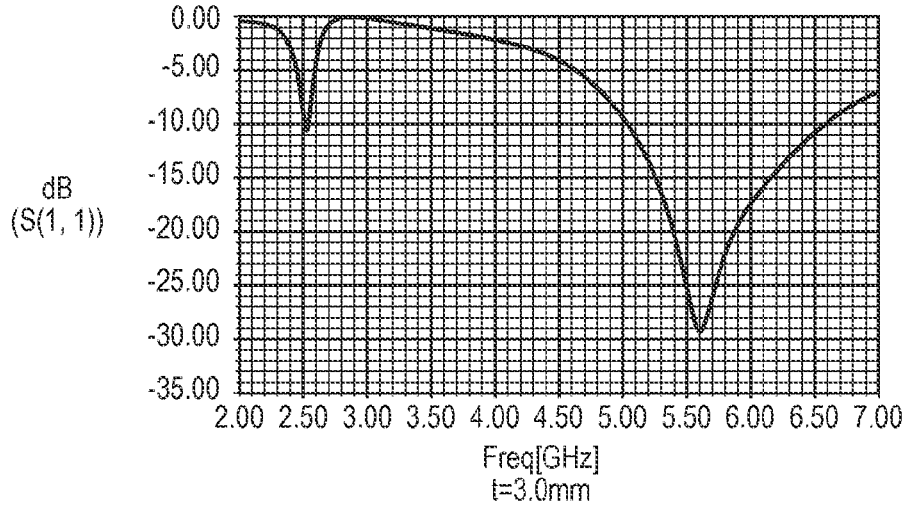

As shown in FIG. 10, a length b of the conductor 204 is changed to change the coupling position of the conductors 203 and 204. FIGS. 11A to 11C are graphs showing a change of the reflection characteristic when a distance t in FIG. 10 is changed to 1.0 mm, 2.0 mm, and 3.0 mm. As is apparent from FIGS. 11A to 11C, as the distance t increases, that is, as the coupling position of the conductors 203 and 204 moves apart from the open end of the second conductor 203 on the low frequency side, the amount of shift of the resonance frequency in the 2.4-GHz band to a low frequency decreases. Also, FIGS. 11A to 11C show that the antenna operating bandwidth in the 2.4-GHz band becomes larger as the distance t increases. It is considered that this is because coupling between the conductors 203 and 204 in the 2.4-GHz band weakens. That is, coupling at a position closer to the open end can shift the resonance frequency to be much lower. Note that the distance t of the dual-band antenna in FIG. 2 is 2.0 mm.

In contrast, the resonance frequency in the 5-GHz band does not greatly change. It is conceivable that the open end of the conductor 204 remains included in the coupling position even if t is changed. However, when the distance t is changed, the path extending from the conductor 202 to the conductor 204, which operate mainly in the 5-GHz band, changes. Owing to the change of the path length, the characteristic in the 5-GHz band slightly varies.

As described above, by changing t, the operating frequency in the 2.4-GHz band can be greatly changed without greatly changing the operating frequency in the 5-GHz band.

(Length of Coupling Portion and Antenna Characteristic)

Figure 12:
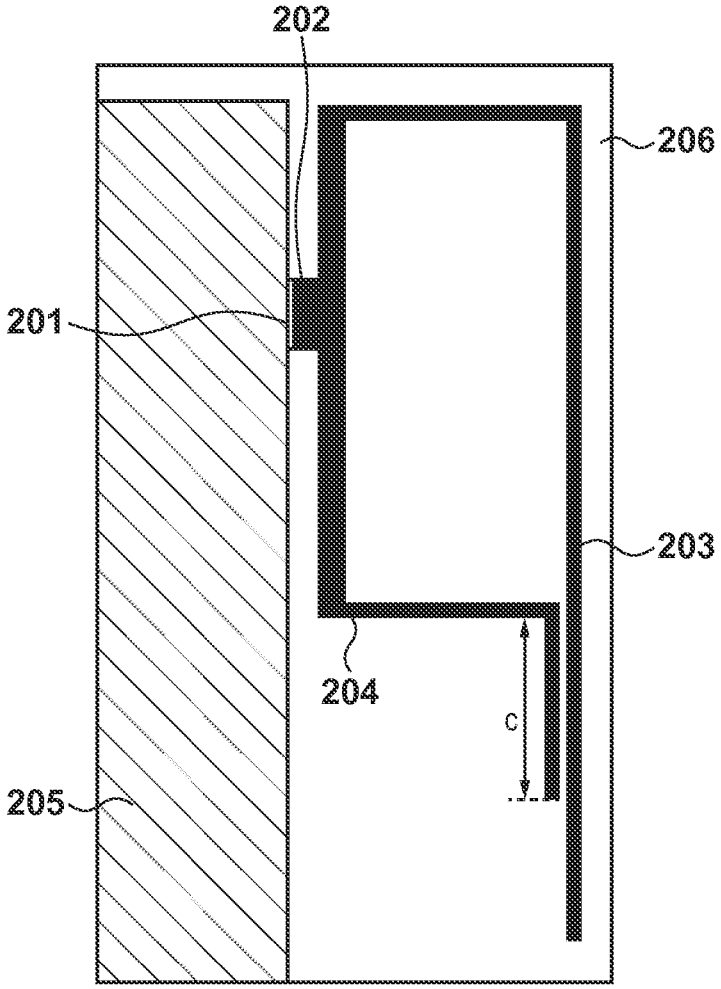
FIG. 12 is a view for explaining the length of the coupling portions of the two conductors of the dual-band antenna.
Figure 13A:
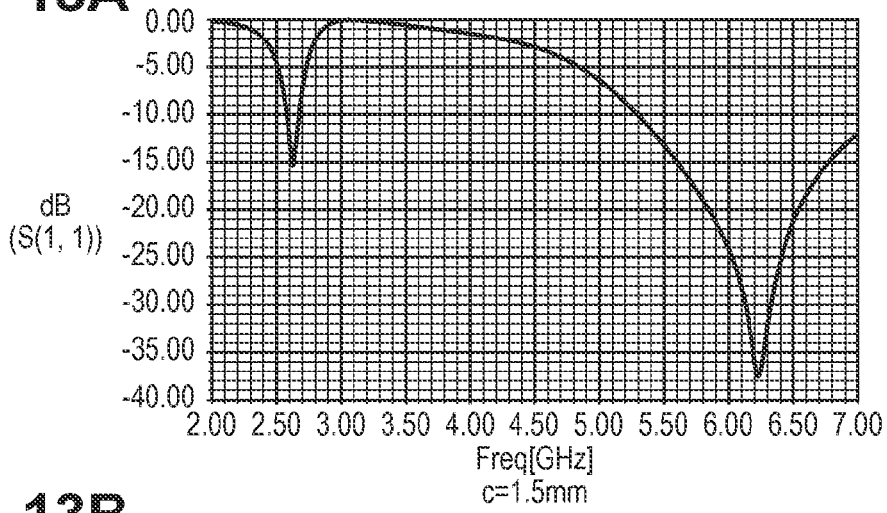
FIGS. 13A to 13C are graphs showing the simulation results of the reflection characteristic (S11) of the dual-band antenna when the length of the coupling portions is changed.
Figure 13B:
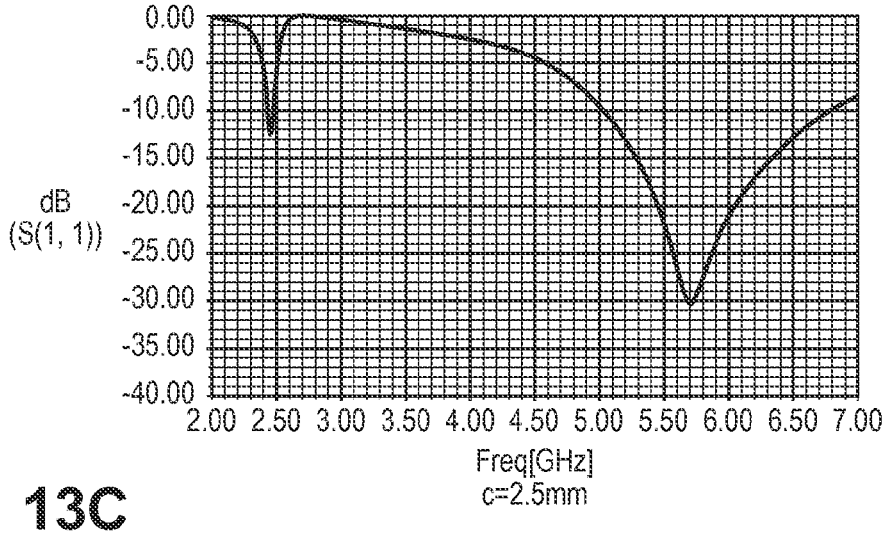
Figure 13C:
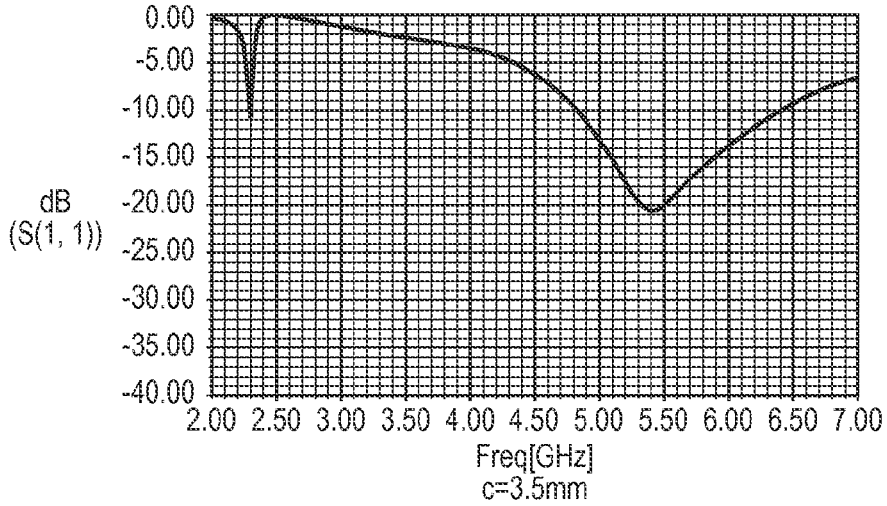

Next, the relationship between the length of the coupling portion at which the conductors 203 and 204 are coupled, and a change of the antenna characteristic will be explained. In this description, a length c of the conductor 204 is changed to change the length of the coupling portions of the conductors 203 and 204, as shown in FIG. 12. Further, the antenna characteristic in this case is shown. FIGS. 13A to 13C are graphs showing the reflection characteristic when the length c of the coupling portion in FIG. 12 is changed to 1.5 mm, 2.5 mm, and 3.5 mm. FIGS. 13A to 13C show that, as the length c becomes larger, the resonance frequency shifts to be lower. That is, as the length of the coupling portions of the conductors 203 and 204 becomes larger, coupling between the conductors 203 and 204 becomes stronger. As the coupling becomes stronger, the resonance frequency shifts to be lower. When attention is focused on the characteristic in the 2.4-GHz band, the antenna operating bandwidth becomes narrower as the length c of the conductor 204 becomes larger. However, when the length c is changed, the path extending from the conductor 202 to the conductor 204, which operate mainly in the 5-GHz band, greatly changes. It is therefore considered that a change of the path length influences the resonance frequency together with a change of the length of the coupling portion in the characteristic in the 5-GHz band. Note that the length c of the dual-band antenna in FIG. 2 is 2.5 mm.

In FIG. 12, even if the length c of the conductor 204 is increased and the open end of the conductor 204 exceeds that of the conductor 203, the coupling portion length and coupling position of the conductor 203 with respect to the conductor 204 do not change. In this case, the operating frequency in the 2.4-GHz band does not greatly change. However, the coupling position of the conductor 204 with respect to the conductor 203 exceeds the open end, and the coupling position changes. The path length of the conductor 204 also changes. By utilizing this, the operating frequency in the 5-GHz band can be adjusted. However, if the length c is simply changed, the operating frequency may vary on the high and low frequency sides owing to a change of coupling with the antenna ground 205.

As described above, as coupling between the conductors 203 and 204 becomes stronger, antenna operating frequencies corresponding to the respective conductors shift to be lower. The embodiment has described that at least one of the distance between the conductors, the positional relationship between the conductors to be coupled, and the length of the coupling portion can be used to adjust the coupling strength.

In general, an antenna has a larger size (length) as the operating frequency becomes lower. According to the embodiment, the resonance frequencies on the low and high frequency sides shift to be low depending on coupling between two conductors. By coupling, the antenna can obtain the same resonance frequencies as those of a larger antenna. By using this effect, the antenna according to the embodiment can implement downsizing of the antenna, and ensure an operating band much larger than a necessary operating band in the 5-GHz operating band. It is known that the antenna length of a monopole antenna serving as a basic antenna is set to about ¼ of the wavelength in the operating frequency band. However, the dual-band antenna according to the embodiment can set the sum of the lengths of the conductors 202 and 203 to be smaller than ¼ of the wavelength of the operating frequency on the low frequency side, and the sum of the lengths of the conductors 202 and 204 to be smaller than ¼ of the wavelength of the operating frequency on the high frequency side. Note that the "wavelength" mentioned here is a wavelength in a space where the antenna is configured. For example, when the antenna is configured in a free space, this wavelength is a wavelength in the free space. When the antenna is configured in an infinitely large dielectric, this wavelength is a wavelength in the dielectric. When the antenna is configured on a dielectric substrate, as in the embodiment, this wavelength is a wavelength calculated using an effective dielectric constant obtained based on an air layer and dielectric layer.

In actual antenna design, the coupling strength is adjusted by adjusting the distance between the conductors 203 and 204 and the length and position of the coupling portions of the conductors 203 and 204, as described above. Accordingly, the impedances in the 2.4-GHz and 5-GHz bands can be adjusted, enabling a design at a high degree of freedom. In this case, when the coupling is strengthened to shift the resonance frequency to be lower, the antenna operating bandwidth may be narrowed. It is therefore important to downsize the antenna while satisfying a necessary antenna operating bandwidth in design. If the antenna region is narrowed to further shorten the short side of the antenna region, the conductors 203 and 204 come close to the antenna ground 205 near the feeding point 201, and may be coupled with the antenna ground 205 to influence the antenna characteristic. However, in the antenna structure according to the embodiment, even if the short side of the antenna region becomes shorter, the open ends of the conductors 203 and 204 are arranged parallelly at a distance from the antenna ground 205 near the feeding point 201. Thus, the antenna according to the embodiment suppresses coupling with the antenna ground 205.

In the dual-band antenna according to the embodiment, the direction from the feeding point 201 toward the open end of the conductor 203 and the direction from the feeding point 201 toward the open end of the conductor 204 are the same or almost the same. The length and position of the coupling portion can be easily changed without interfering with another antenna conductor, so the degree of design freedom can be further increased.

As described above, the structure of the dual-band antenna shown in FIG. 2 makes it possible to adjust the strength of coupling generated between the conductors 203 and 204 and obtain a desired antenna characteristic. As a result, a compact, low-profile dual-band antenna with a high degree of design freedom can be implemented.

Figure 14:
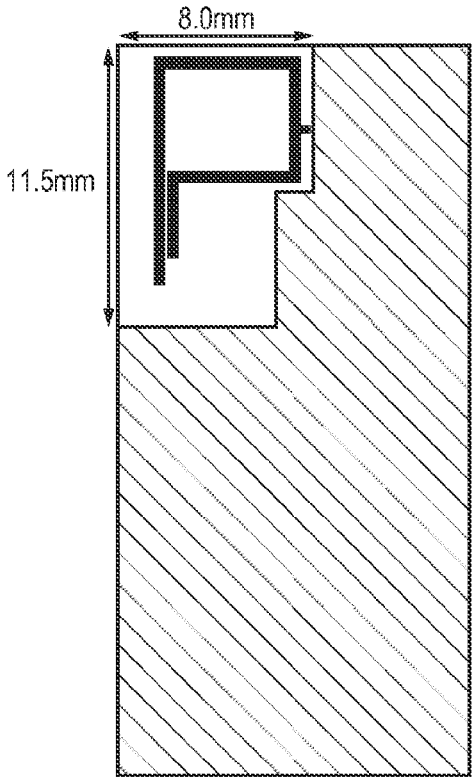
FIG. 14 is a front view exemplifying another structure of the dual-band antenna.

The dual-band antenna according to the embodiment can also be implemented by a shape other than one shown in FIG. 2. For example, FIG. 14 is a front view showing a dual-band antenna designed on a substrate different from that in FIG. 2. In the example of FIG. 14, the relative dielectric constant of the dielectric substrate (FR4 substrate) is 4.4. A portion on the dielectric substrate (FR4 substrate) where no antenna ground exists is the antenna region. The shape of the antenna region is not a rectangle. The dimensions of the antenna region are described in FIG. 14, and the maximum length of the short side is 8 mm, and the length of the long side is 11.5 mm. In FIG. 14, similar to FIG. 2, black portions represent the conductors, and a hatched portion represents the antenna ground. Resists are formed on the respective conductors and antenna ground of the dual-band antenna. The thickness of the substrate including all the dielectric substrate, conductor, and resist is 0.7675 mm.

Figure 15:
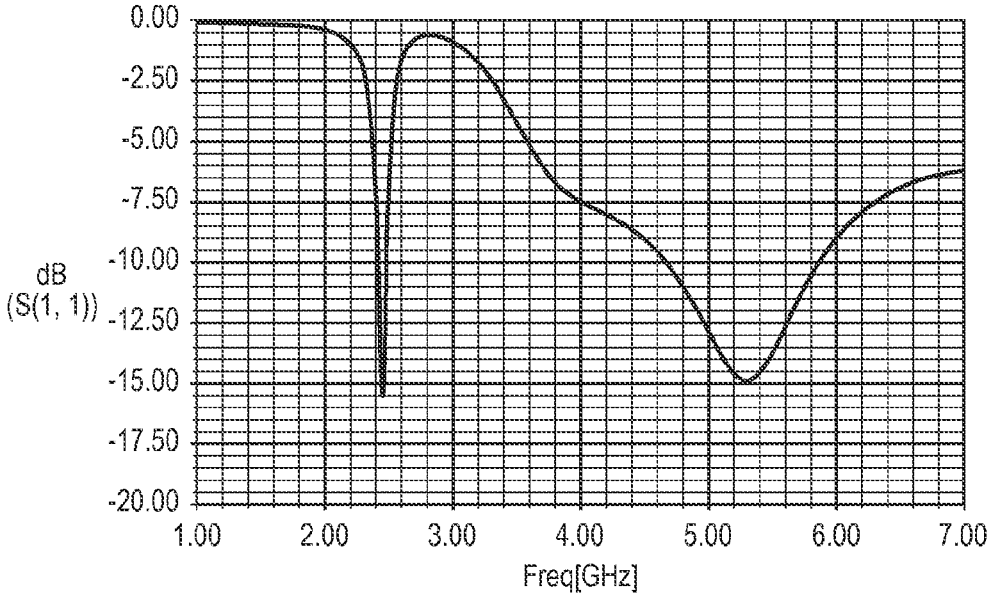
FIG. 15 is a graph showing the simulation result of the reflection characteristic (S11) of the dual-band antenna in FIG. 14.

FIG. 15 is a graph showing the simulation result of the reflection characteristic (S11) of the dual-band antenna in FIG. 14. As shown in FIG. 15, the dual-band antenna in FIG. 14 obtains a reflection characteristic in which the bandwidth at which the reflection characteristic is equal to or lower than −6 dB in the 2.4-GHz band is about 120 MHz, and the bandwidth at which the reflection characteristic is equal to or lower than −10 dB in the 5-GHz band is about 1.2 GHz. Hence, the dual-band antenna in FIG. 14 can ensure much wider operating bandwidths than requested ones in both the 2.4-GHz and 5-GHz frequency bands used in IEEE802.11a/b/g/n. That is, the dual-band antenna in the form as shown in FIG. 14 can operate as an antenna used in IEEE802.11a/b/g/n.

Although the embodiment has described the dual-band antenna which operates in the 2.4-GHz and 5-GHz bands used in IEEE802.11a/b/g/n, a dual-band antenna in other frequency bands can be designed similarly. The embodiment has described the dual-band antenna having two operating frequency bands, but a multi-band antenna which operates in a larger number of operating frequency bands can be configured by increasing the number of antenna conductors. More specifically, an example in which the antenna includes the two second conductors 203 and 204 has been described, but a multi-band antenna can be implemented by increasing the number of second conductors to three or more. In this case, two of a plurality of second conductors forming the multi-band antenna are coupled, thereby obtaining the same effects as those in the case in which the number of second conductors is two. For example, even if a plurality of second conductors are coupled at one coupling portion, the same effects as those in coupling between two conductors are obtained.

In the embodiment, the dual-band antenna is implemented by a pattern formed on the FR4 substrate. However, the dual-band antenna may be formed from a sheet metal or lead wire, or a lead wire in a high-dielectric member such as ceramic. As for feeding to the dual-band antenna in the embodiment, only the feeding point has been described in the embodiment, and a feeder line to the feeding point has not been described in detail. However, the feeder line is not particularly limited and may be, for example, a plane circuit typified by a microstrip line, slot line, or coplanar line, or a transmission line for transmitting an electromagnetic wave, such as a coaxial line or waveguide.

In the embodiment, the conductors 203 and 204 extend from the feeding point 201 toward their open ends in the same or almost the same directions, and are arranged parallelly or almost parallelly. However, the conductors 203 and 204 are not limited to this. It suffices to partially couple the conductors 203 and 204 to each other and arrange them at positions where they do not interfere with another antenna conductor even if the length or position of the coupling portion is changed. For example, a region where the distance between the conductors 203 and 204 is equal to or smaller than a predetermined value is ensured as the coupling portion. At this portion, for example, at least either the conductor 203 or 204 has a wavy or curved shape.

Also in this case, the directions from the feeding point toward the open ends of the conductors 203 and 204 are designed not to be opposite to each other on the whole. That is, the inner product of two vectors to the respective conductors 203 and 204, which are determined by directions from the feeding point toward their open ends on lines passing through the centers of the conductors at, at least part of the coupling portion, is set to be a positive value. The positive value of the inner product means that the angle defined by the directions in which the two conductors extend is smaller than 90°, and that the two conductors extend in almost the same direction. Since the directions from the feeding point toward the open ends of the two conductors are not opposite at the coupling portion, the degree of design freedom of the shapes of the two conductors respectively forming two antenna elements is greatly increased. In other words, the shapes of the two antennas hardly restrict each other's lengths, and the degree of design freedom of the antenna can be increased.

The conductors 203 and 204 are coupled near their open ends in the embodiment, but the coupling portions may be portions other than the vicinity of the open ends. That is, the conductors 203 and 204 may be coupled not at their ends but at another portion. This can further increase the degree of design freedom.

<<Second Embodiment>>

The first embodiment has described the dual-band antennas having the structures in FIGS. 2 and 14. In the second embodiment, the distance d between conductors 203 and 204 can be increased by devising the shape of the conductor 203 of the dual-band antenna described in the first embodiment. The antenna characteristic on the low frequency side can be widened.

Figure 16:
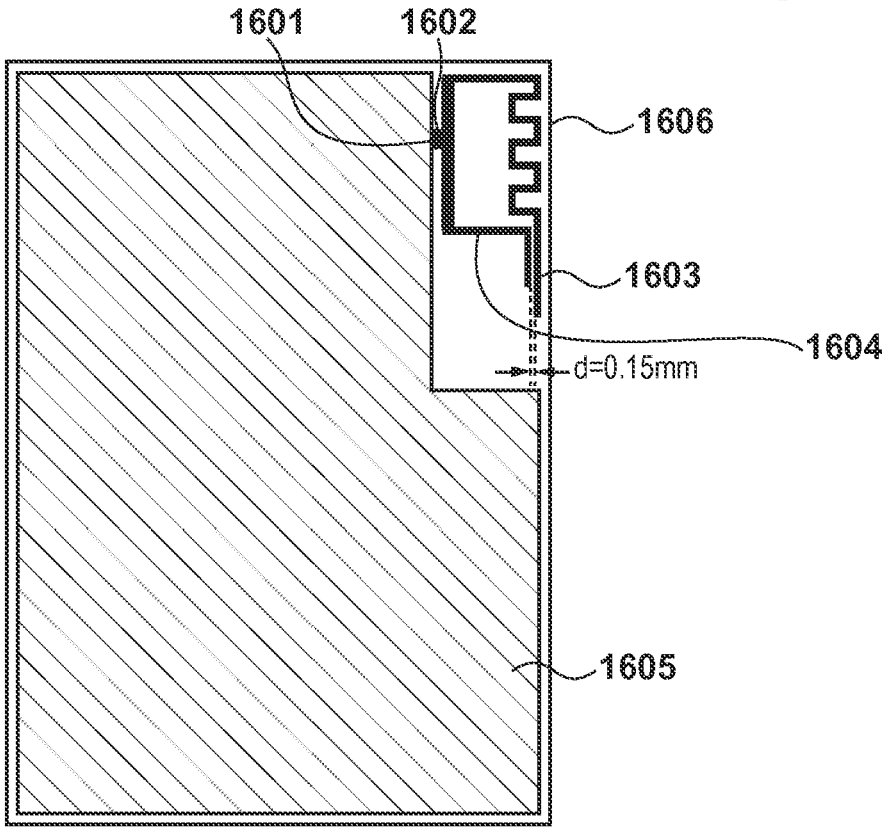
FIG. 16 is a front view exemplifying the structure of a dual-band antenna according to the second embodiment.

FIG. 16 is a front view showing a dual-band antenna used in the second embodiment. A dielectric substrate (FR4 substrate) 1606, antenna ground 1605, and resist shown in FIG. 16 are the same as those in the first embodiment. The thickness of the substrate including all the dielectric substrate, conductor, and resist is also the same as that in the first embodiment and is 0.878 mm. In the structure of FIG. 16, a conductor 1603 has a meander line shape, unlike the first embodiment. By forming the antenna into the meander line shape, the path length of the conductor 1603 can become larger than that of the conductor 203 in FIG. 2. As described in the first embodiment, as coupling between the conductors 203 and 204 in FIG. 2 becomes stronger, the antenna operating frequency shifts to be lower. As the path length of the conductor of the antenna becomes larger, the antenna operating frequency shifts to be lower.

In the second embodiment, the conductor 1603 in FIG. 16 is formed into the meander line shape so that the path length of the conductor becomes larger than that of the conductor 203 in FIG. 2. Thus, the operating frequency on the low frequency side decreases, compared to that of the antenna on the low frequency side in FIG. 2. In FIG. 16, coupling between the conductors 1603 and 1604 for decreasing the operating frequency on the low frequency side can be weaker than coupling between the conductors 203 and 204 in FIG. 2. For this reason, the distance d between the conductors 1603 and 1604 in FIG. 16 is set to 0.15 mm in the second embodiment.

Figure 17:
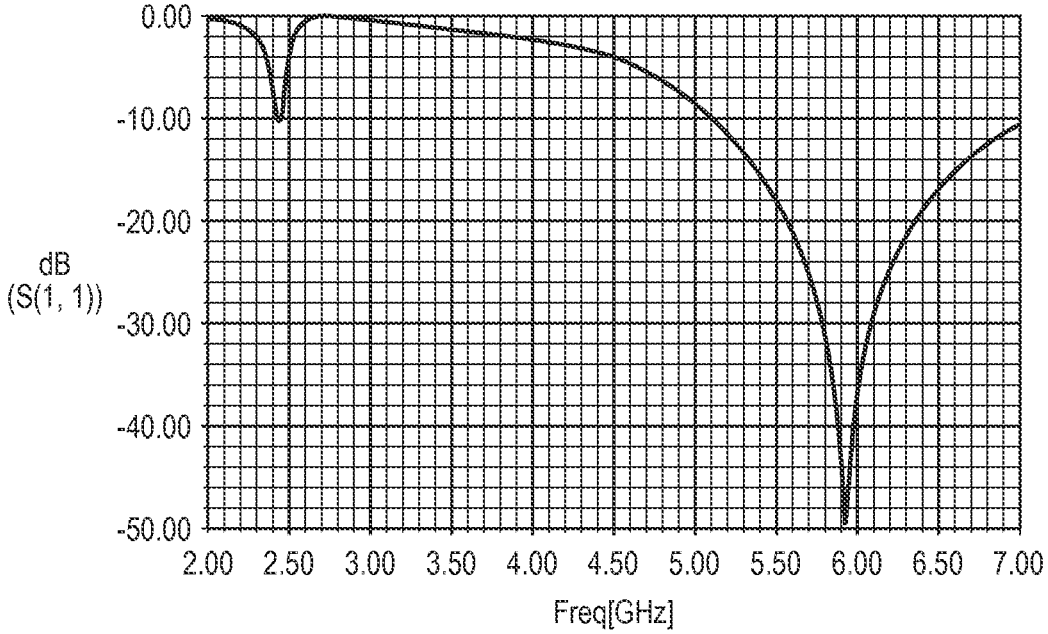
FIG. 17 is a graph showing the simulation result of the reflection characteristic (S11) of the dual-band antenna in FIG. 16.

FIG. 17 shows the simulation result of the reflection characteristic (S11) of the dual-band antenna shown in FIG. 16. From a comparison between FIG. 3 showing the antenna characteristic in FIG. 2 described in the first embodiment and FIG. 17 showing the antenna characteristic in FIG. 16, the bandwidth at which the reflection characteristic is equal to or lower than −6 dB is almost the same in the 2.4-GHz and 5-GHz bands. The resonance frequency on the low frequency side exhibits almost the same characteristic in both FIGS. 3 and 17.

The distance d between the conductors 203 and 204 in FIG. 2 is 0.1 mm, whereas the distance d between the conductors 1603 and 1604 in FIG. 16 is 0.15 mm, as described above. Even if the distance d between the conductors is increased by forming the conductor 1603 into the meander line shape, as shown in FIG. 16, almost the same characteristic on the low frequency side as that of the dual-band antenna having the structure of FIG. 2 can be obtained. As described above, the distance d between the conductors determines the coupling strength and also determines the antenna operating frequency. The distance d between the conductors in FIG. 2 is 0.1 mm and is a very short distance. This may cause an error of the antenna characteristic when manufacturing the dual-band antenna. Therefore, the design becomes easy by increasing the distance d between the conductors, as in the second embodiment.

In the antenna of FIG. 16, the conductor 1604 does not have the meander line shape, coupling is weaker than in FIG. 2, and the resonance frequency on the high frequency side remains high in comparison with FIG. 3. However, the resonance frequency on the high frequency side can also be decreased by similarly forming the conductor 1604 into the meander line shape. By decreasing the resonance frequency using the meander line shape, as in the second embodiment, the degree of freedom of the distance d between the conductors for coupling can be increased to facilitate the design.

Figure 18:
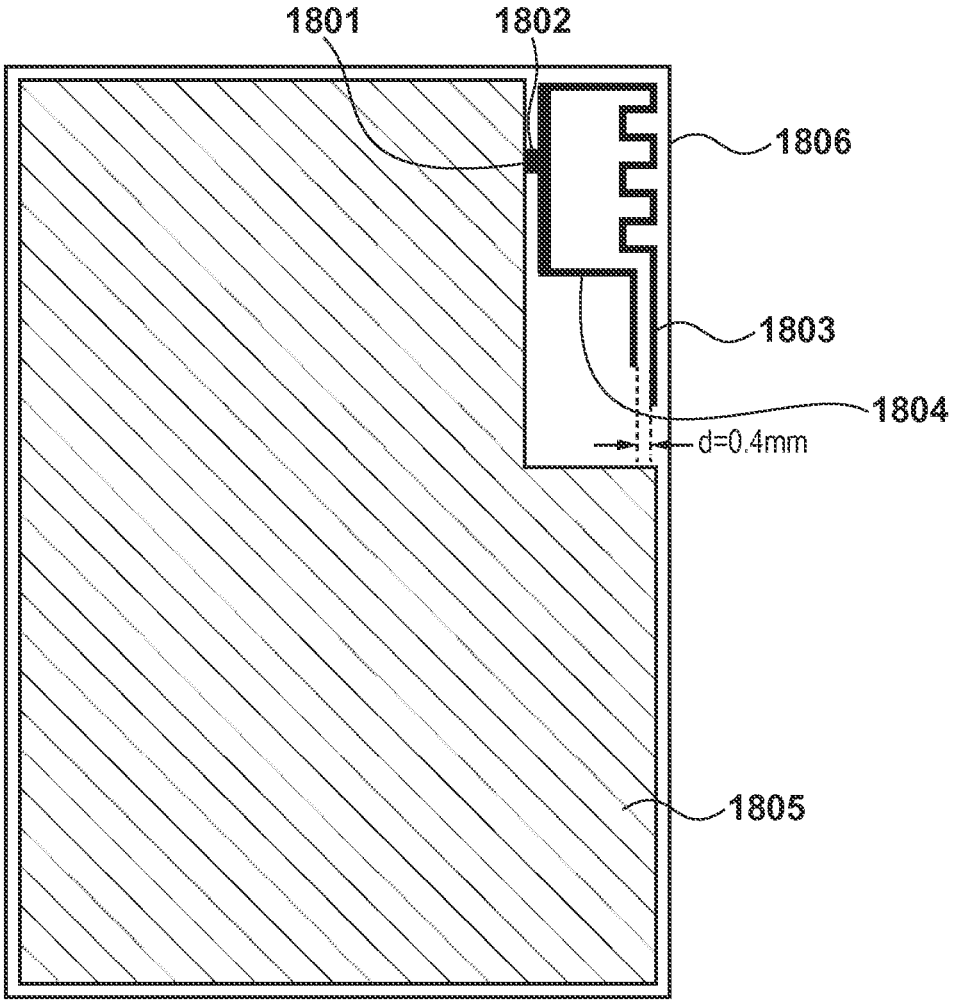
FIG. 18 is a front view exemplifying another structure of the dual-band antenna according to the second embodiment.
Figure 19:
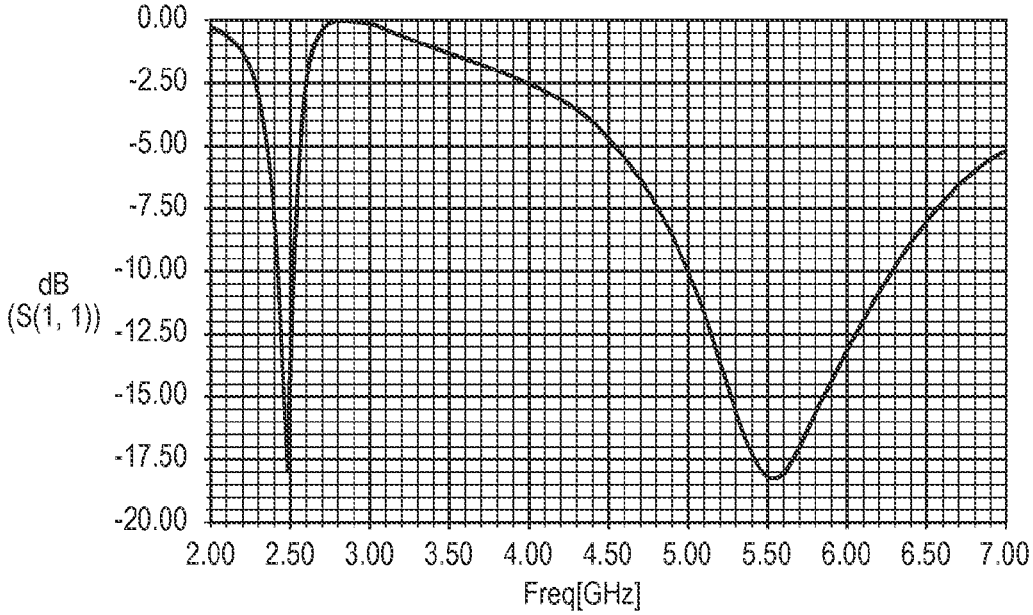
FIG. 19 is a graph showing the simulation result of the reflection characteristic (S11) of the dual-band antenna in FIG. 18.

FIG. 18 is a front view showing a dual-band antenna when the length and position of each conductor are further adjusted using the meander line shape, like the dual-band antenna in FIG. 16. The distance d between conductors 1803 and 1804 in FIG. 18 is 0.4 mm. FIG. 19 shows the simulation result of the reflection characteristic (S11) of the dual-band antenna shown in FIG. 18.

From a comparison between FIGS. 3 and 19, the bandwidth at which a reflection characteristic of −6 dB or less is obtained in the 2.4-GHz band is about 100 MHz in the antenna structure of FIG. 2, but this bandwidth is increased to about 180 MHz in the antenna structure of FIG. 18. As described in the first embodiment, as coupling is weakened, the antenna operating band is widened. Coupling between the two conductors 1803 and 1804 can be weakened by forming the conductor 1803 into the meander line shape, as in FIG. 18 according to the second embodiment, compared to the antenna structure in FIG. 2. As a result, the antenna operating band in the 2.4-GHz band can be widened.

Although only the conductor 1803 has the meander line shape in the second embodiment, the same effects as those described above can also be obtained by forming only the conductor 1804 or both the conductors 1803 and 1804 into the meander line shape. In the second embodiment, the conductor is formed into the meander line shape as a method of increasing the path length of the conductor. However, the conductor may have another shape as long as the path length can be increased.

<<Third Embodiment>>

When an antenna is assembled in the body of an electronic device, the antenna characteristic varies under the influence of the member of the body of the electronic device. This is also obvious from the fact that the antenna operating frequency shifts to be low when a member having a dielectric constant larger than that of air is brought close to the antenna.

When the antenna is assembled in the body of the electronic device, the antenna operating frequency shifts, so the antenna characteristic needs to be adjusted. For example, for an antenna having only one operating frequency band, a shift of the antenna characteristic upon assembly into the body can be adjusted by a matching circuit connected to the antenna.

However, when the dual-band antenna is assembled in the body of the electronic device, the antenna characteristic shifts in the two, low and high operating frequency bands, and the antenna characteristic needs to be adjusted in the two frequency bands.

The third embodiment will explain adjustment of a varying antenna characteristic when the dual-band antenna described in the first embodiment is assembled in the body of an electronic device.

The dual-band antenna described in the third embodiment is a dual-band antenna which operates in both the 2.4-GHz and 5-GHz frequency bands used in IEEE802.11a/b/g/n, similar to the first embodiment. The dual-band antenna has the structure as shown in FIG. 2, similar to the first embodiment, and operates in the 2.4-GHz and 5-GHz bands, as shown in FIG. 3. On the high frequency side (5-GHz band), a much larger operating bandwidth than a necessary one is ensured.

A case in which the dual-band antenna described in the first embodiment is assembled in the body of an electronic device will be examined. In this case, the antenna operating frequencies in the 2.4-GHz and 5-GHz bands shift under the influence of the body of the electronic device. The third embodiment will explain a method of adjusting the antenna characteristic by bringing a dielectric substance into contact with or close to the dual-band antenna shown in FIG. 2 and adding it.

Figure 20:
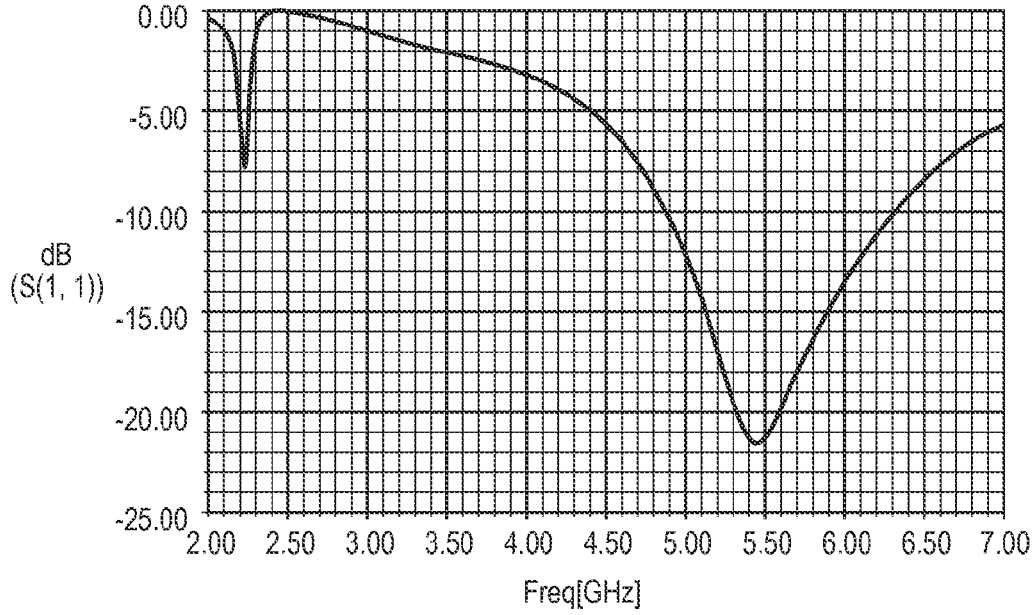
FIG. 20 is a graph showing the simulation result of the reflection characteristic (S11) of the dual-band antenna when a dielectric sheet is adhered to the dual-band antenna in FIG. 2.

The dielectric substance to be added in the third embodiment is a dielectric sheet having a relative dielectric constant of larger than 1. The dielectric sheet is adhered to an entire surface of the substrate on a side on which conductors 202 to 204 and antenna ground 205 of the dual-band antenna shown in FIG. 2 exist. The dielectric sheet has a thickness of 0.2 mm and a relative dielectric constant of 4.4. FIG. 20 is a graph showing the simulation result of the reflection characteristic (S11) of the dielectric sheet-adhered dual-band antenna.

A comparison is made between FIG. 3 showing the antenna characteristic of the antenna in FIG. 2 described in the first embodiment to which no dielectric sheet is adhered, and FIG. 20 showing the antenna characteristic of the similar antenna to which the dielectric sheet is adhered.

First, FIGS. 3 and 20 are compared for the 2.4-GHz band. The resonance frequency is about 2.46 GHz in the reflection characteristic (S11) of the 2.4-GHz band in FIG. 3, and about 2.24 GHz in the reflection characteristic (S11) of the 2.4-GHz band in FIG. 20. This reveals that the resonance frequency in the 2.4-GHz band shifts to be low upon adhering the dielectric sheet. Then, FIGS. 3 and 20 are compared for the 5-GHz band. The resonance frequency is about 5.7 GHz in the reflection characteristic (S11) of the 5-GHz band in FIG. 3, and about 5.45 GHz in the reflection characteristic (S11) of the 5-GHz band in FIG. 20. This represents that the resonance frequency in the 5-GHz band also shifts to be low upon adhering the dielectric sheet.

By adhering the dielectric sheet to the antenna, the wavelength of an electromagnetic wave near the antenna can be shortened, and the resonance frequency can be shifted to be low. The ratio of shortening of the wavelength of the electromagnetic wave can be controlled by at least one of the relative dielectric constant, thickness, and area of the dielectric sheet. When the relative dielectric constant of the dielectric sheet is increased, the resonance frequency of the antenna further shifts to be low. When the thickness of the dielectric sheet is increased, the resonance frequency of the antenna further shifts to be low. When the area of the dielectric sheet is increased to increase the area by which the dielectric sheet is adhered to the antenna, the resonance frequency of the antenna further shifts to be low.

As described above, when the dielectric sheet for covering the entire antenna is used to shift the resonance frequency in, for example, the 2.4-GHz band to be low, even the resonance frequency in the 5-GHz band shifts to be low. However, the dual-band antenna according to the embodiment ensures a much larger operating bandwidth on the high frequency side (5-GHz band) than a necessary operating bandwidth. The antenna suffices to operate as an antenna at the use bandwidth of a wireless LAN. Even if the operating frequency on the high frequency side (5-GHz band) shifts to be low upon adhering the dielectric sheet, this hardly poses a problem in practical use because the dual-band antenna ensures a very large operating bandwidth.

When the operating bandwidth of one band (high frequency side in this example) in the dual-band antenna is much larger than a requested operating bandwidth, variations of the antenna characteristic upon assembly into the body may be adjusted by paying attention to only the antenna characteristic in the other band (low frequency side). Even when the dual-band antenna structure as shown in FIG. 2 can be assembled into a plurality of models of electronic devices and the antenna characteristic varies, an appropriate antenna characteristic can be implemented regardless of the device by adjusting only the characteristic in the 2.4-GHz band by using the dielectric sheet. While maintaining the antenna characteristic upon assembly into a product, the development man-hour of antenna implementation can be reduced, and the antenna characteristic upon assembly into the body can be easily optimized.

As described in the first embodiment, it is known that the path extending from the conductor 202 to the conductor 203 mainly contributes to the antenna characteristic on the low frequency side in the dual-band antenna shown in FIG. 2. It is also known that the path extending from the conductor 202 to the conductor 204 mainly contributes to the antenna characteristic on the high frequency side. Considering this, a portion where the dielectric sheet is adhered may be selected in accordance with a frequency band in which the operating frequency is to be shifted to be low. Accordingly, the adjustment can be performed more effectively. For example, when shifting the operating frequency in the 2.4-GHz band to be low, the dielectric sheet may be adhered not to the entire antenna but near the conductors 202 and 203 in FIG. 2. Further, the operating frequency in the 2.4-GHz band is adjusted by the same method even in the antenna as shown in FIG. 14, 16, or 18, and the operating frequency can be appropriately adjusted in the entire antenna.

Although the third embodiment has described a case in which the sheet-like dielectric substance is adhered to the entire surface of the substrate, the dielectric sheet may be a dielectric substance having a large thickness. Also, the antenna characteristic can be adjusted by not only adhering the dielectric sheet and dielectric substance to the antenna, but also arranging them to be spaced part from each other within a predetermined distance. The predetermined distance when the antenna characteristic is adjusted by arranging the dielectric sheet and dielectric substance in the antenna to be spaced part from each other within the predetermined distance depends on the frequency at which the antenna operates. When the predetermined distance is set to about 10 mm or less, the antenna characteristic can be efficiently adjusted in the dual-band antenna for the wireless LAN that operates in the 2.4-GHz and 5-GHz bands, as in the embodiment.

<<Fourth Embodiment>>

In the above-described embodiments, all the conductors are arranged on the same flat surface of the dielectric substrate (FR4 substrate). To the contrary, in a dual-band antenna according to the fourth embodiment, conductors are arranged on the two surfaces of a dielectric substrate (FR4 substrate), and the coupling portions of second conductors are configured to face each other via the dielectric substrate (FR4 substrate). For example, one of the two second conductors is formed on the first flat surface at the coupling portion, and the other is formed on the second flat surface different from the first flat surface. At this time, the first flat surface is the front surface of the dielectric substrate, and the second flat surface is the back surface of the dielectric substrate. For example, the first flat surface is a flat surface between the first and second layers of a multilayer substrate, and the second flat surface is a flat surface between the second and third layers of the multilayer substrate. In this structure, the two second conductors are arranged at, for example, positions where they face each other via the dielectric substrate. The distance between the two conductors is set to be equal to or shorter than a predetermined distance, and these conductors are coupled. In addition to this structure, it will be explained that the coupling amount can be adjusted by the line width of the coupling portion, and that an antenna having this structure can be manufactured without requiring high manufacturing accuracy.

Figure 21A:
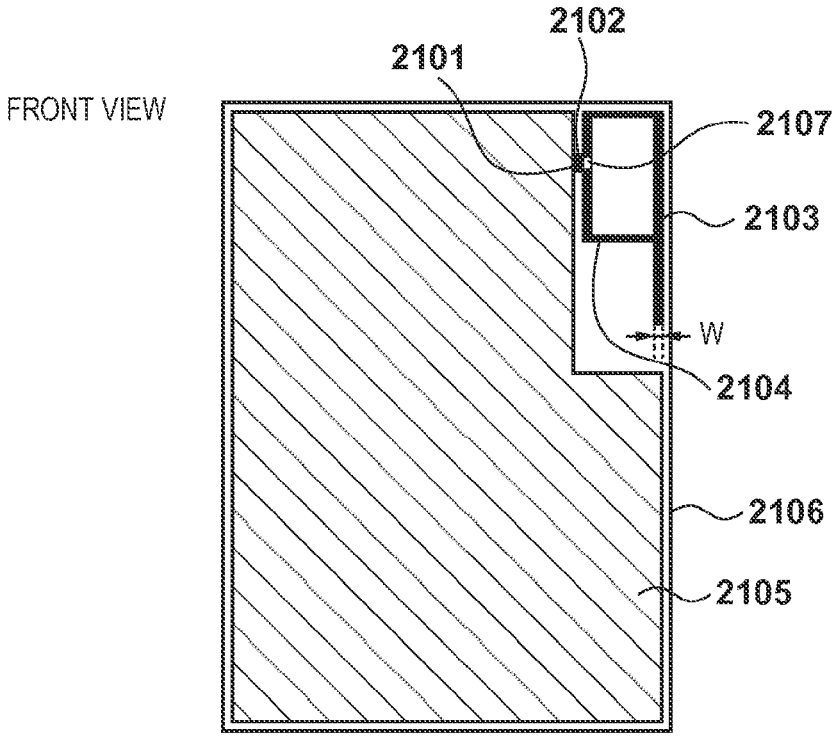
FIGS. 21A and 21B are a front view and perspective view, respectively, exemplifying the structure of a dual-band antenna according to the fourth embodiment.
Figure 21B:
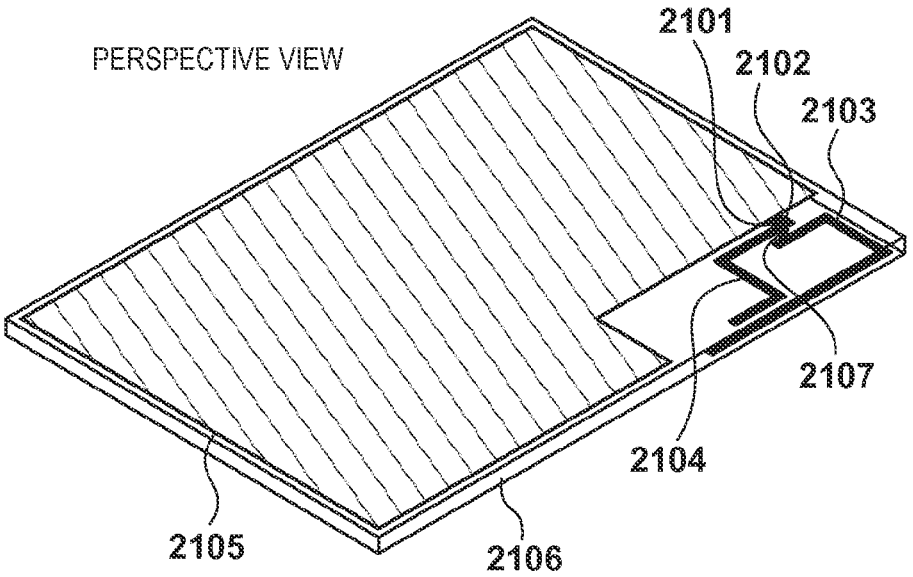

FIG. 21A is a front view showing a dual-band antenna according to the fourth embodiment. FIG. 21B is a perspective view. In the dual-band antenna, a dielectric substrate (FR4 substrate) 2106, antenna ground 2105, and resist are the same as those in the first embodiment. The thickness of the substrate including all the dielectric substrate, conductor, and resist is also the same as that in the first embodiment and is 0.878 mm. In the structure of this dual-band antenna, two second conductors 2103 and 2104 are formed on facing surfaces of the dielectric substrate, unlike the first embodiment. More specifically, for example, the conductor 2104 is formed on the same surface of the dielectric substrate as that of a first conductor 2102, and the conductor 2103 is formed on a facing surface of the dielectric substrate, as shown in FIG. 21B. As shown in FIGS. 21A and 21B, the open end portions serving as the coupling portions of the two conductors 2103 and 2104 are formed to overlap each other when viewed from a direction perpendicular to the substrate surface. The conductor 2103 formed on a surface facing the surface on which the conductor 2104 is formed is connected to a feeding point 2101 and the first conductor 2102 through a via 2107.

In this structure, the strength of coupling between the conductors 2103 and 2104 can be adjusted by a line width w of the coupling portions of the conductors 2103 and 2104. The relationship between the line width of the conductor including the coupling portions of the two conductors 2103 and 2104, and a change of the antenna characteristic will be explained.

Figure 22A:
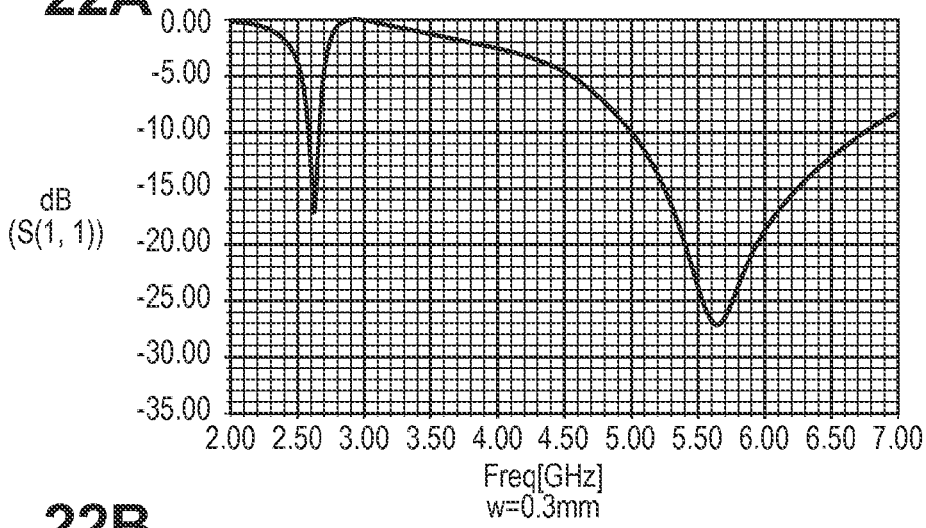
FIGS. 22A to 22C are graphs showing the simulation results of the reflection characteristic (S11) when the line width of the coupling portion of the dual-band antenna in FIGS. 21A and 21B is changed.
Figure 22B:
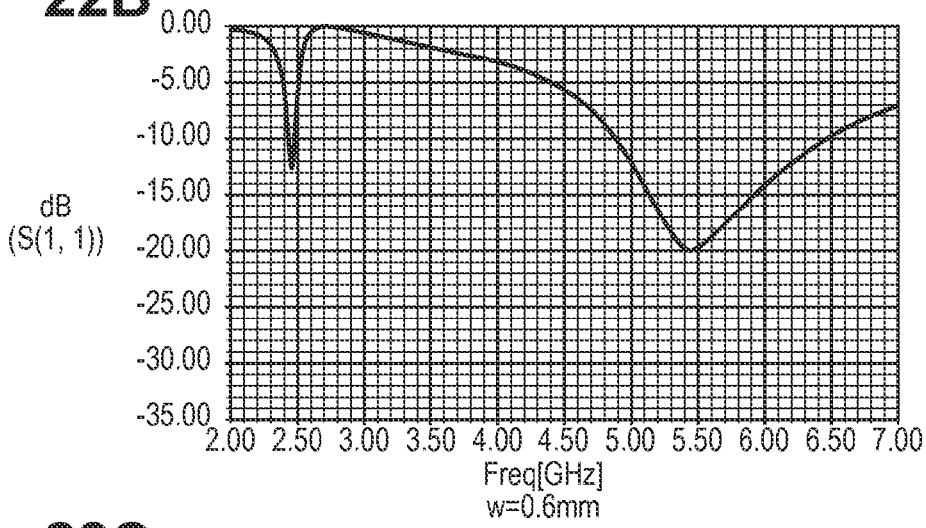
Figure 22C:
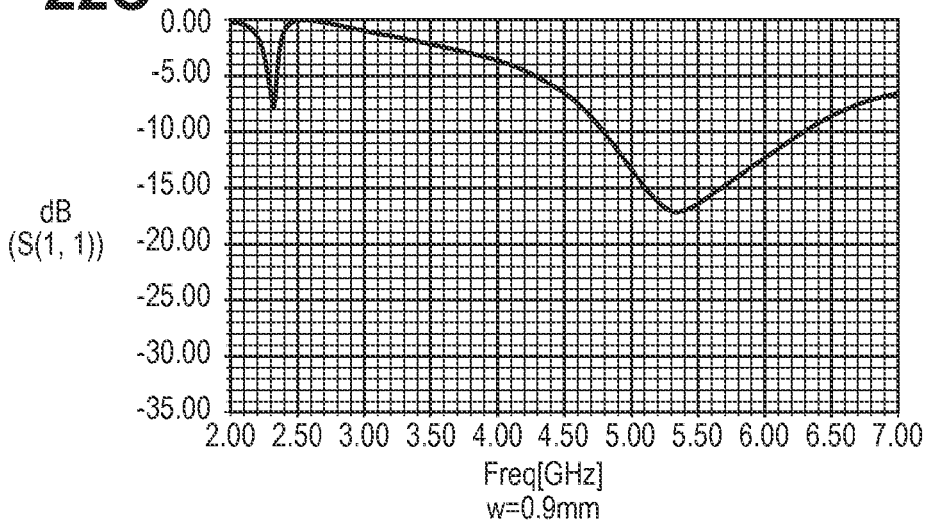

FIGS. 22A to 22C are graphs showing the simulation results of the reflection characteristic when the line width w of the conductor including the coupling portions of the two conductors 2103 and 2104 in FIG. 21A is changed to 0.3 mm, 0.6 mm, and 0.9 mm. The characteristic in FIG. 22B is a reflection characteristic obtained when the line width w of the conductor is set to 0.6 mm and the length of each conductor is adjusted so that the dual-band antenna operates at the use bandwidth of a wireless LAN. FIGS. 22A and 22C show reflection characteristics obtained when the length of each conductor is fixed to a value used in the simulation of FIG. 22B and the line width w of the conductor is adjusted to 0.3 mm and 0.9 mm, respectively.

FIGS. 22A to 22C reveal that the resonance frequency shifts to be lower as the line width w becomes larger. That is, as the line width of the coupling portions of the conductors 2103 and 2104 becomes larger, coupling between them at the coupling portion becomes stronger. As the coupling becomes stronger, the resonance frequency shifts to be lower. When attention is focused on the characteristics in the 2.4-GHz and 5-GHz bands, the antenna operating bandwidth becomes narrower as the line width w of the two conductors 2103 and 2104 becomes larger.

In the structure of FIGS. 21A and 21B, the second conductor 2103 is formed on a surface facing a surface of the dielectric substrate on which the feeding point 2101, first conductor 2102, and second conductor 2104 are formed. However, the dual-band antenna is not limited to this structure. For example, a structure as shown in FIGS. 23A and 23B is available as long as the coupling characteristic can be adjusted by changing the line width of the conductor including the coupling portion.

Figure 23A:
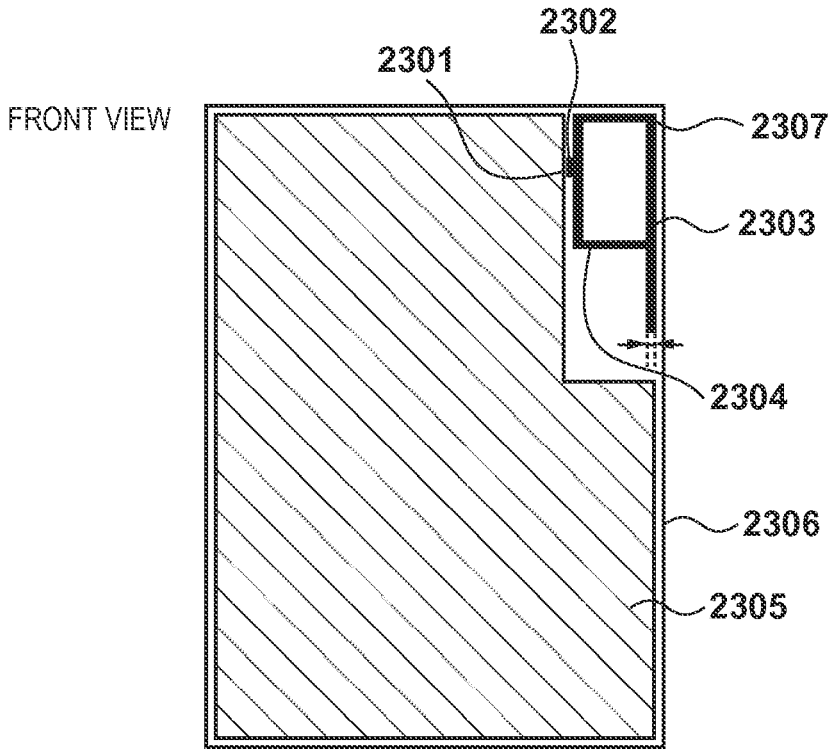
FIGS. 23A and 23B are a front view and perspective view, respectively, exemplifying another structure of the dual-band antenna according to the fourth embodiment.
Figure 23B:
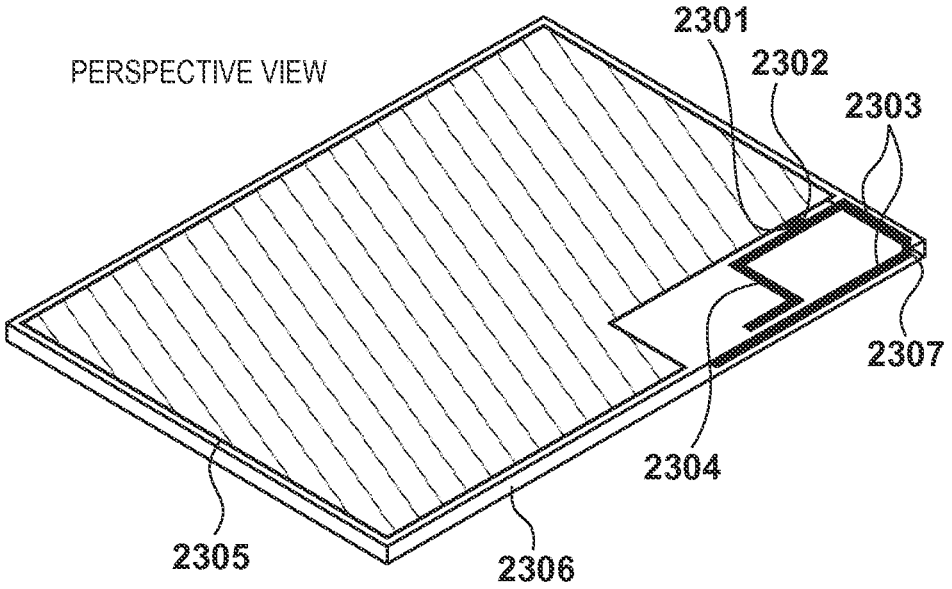

FIGS. 23A and 23B are a front view and a perspective view, respectively, exemplifying another structure of the dual-band antenna according to the fourth embodiment. A dielectric substrate (FR4 substrate) 2306, antenna ground 2305, and resist in the dual-band antenna are the same as those in the first embodiment. The thickness of the substrate including all the dielectric substrate, conductor, and resist is also the same as that in the first embodiment and is 0.878 mm. In this dual-band antenna, the entire conductor contributing to the antenna characteristic on the low frequency side is not formed on a facing surface of the dielectric substrate, unlike the conductor 2103 shown in FIG. 21B. However, part of the conductor, including the coupling portion, is formed on the facing surface of the dielectric substrate. As shown in FIG. 23B, the open end portions serving as the coupling portions of two second conductors 2303 and 2304 are formed to overlap each other when viewed from a direction perpendicular to the substrate surface. The connection portion of the conductor 2303 formed to lie across the two surfaces is connected through a via 2307.

Figure 24A:
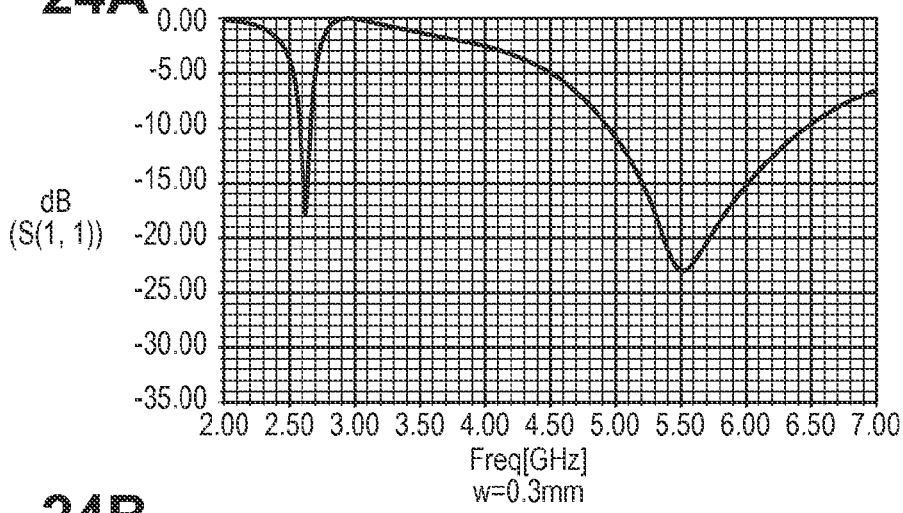
FIGS. 24A to 24C are graphs showing the simulation results of the reflection characteristic (S11) when the line width of the coupling portion of the dual-band antenna in FIGS. 23A and 23B is changed.
Figure 24B:
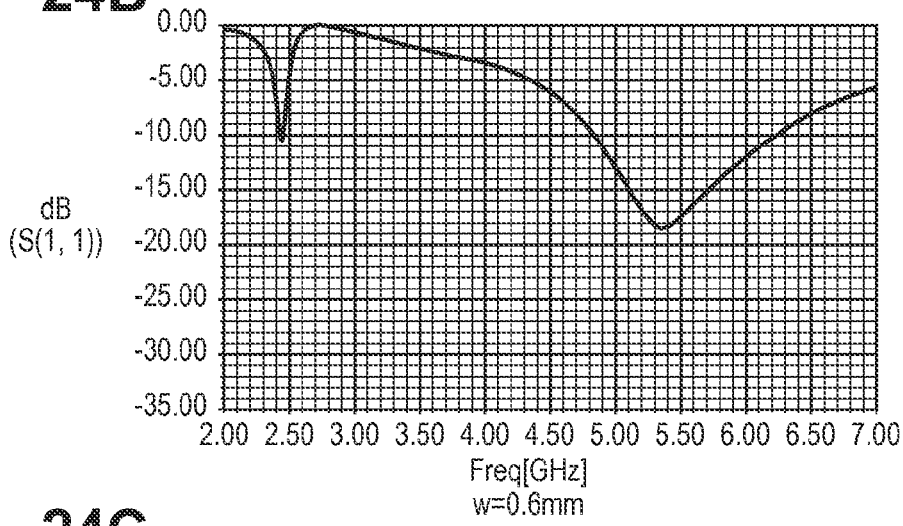
Figure 24C:
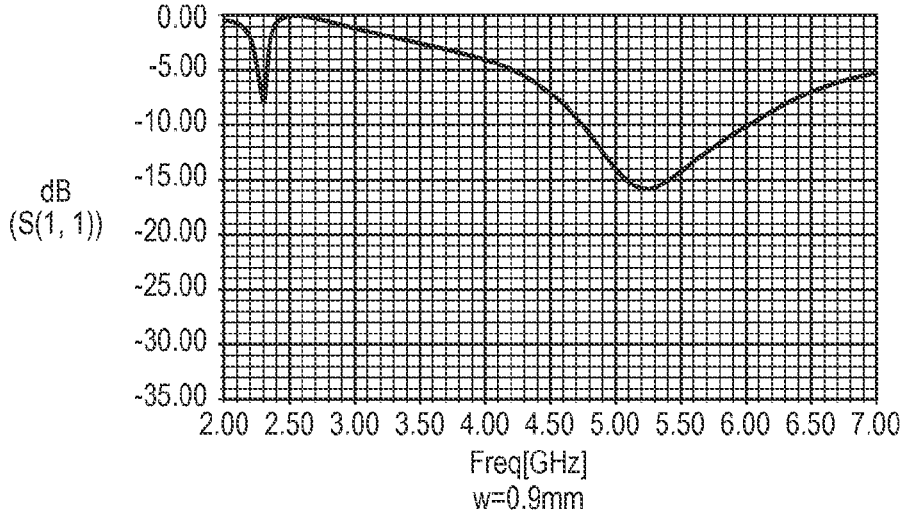

It will be explained with reference to FIGS. 24A to 24C that the strength of coupling between the two conductors 2303 and 2304 can be adjusted by the line width w of the coupling portion even in this structure. FIGS. 24A to 24C are graphs showing the simulation results of the reflection characteristic when the line width w of the conductor including the coupling portions of the two conductors 2303 and 2304 in FIGS. 23A and 23B is changed to 0.3 mm, 0.6 mm, and 0.9 mm. The characteristic in FIG. 24B is a reflection characteristic obtained when the line width w of the conductor is set to 0.6 mm and the length of each conductor is adjusted so that the dual-band antenna operates at the use bandwidth of a wireless LAN. FIGS. 24A and 24C show reflection characteristics obtained when the length of each conductor is fixed to a value used in the simulation of FIG. 24B and the line width w of the conductor is adjusted to 0.3 mm and 0.9 mm, respectively.

FIGS. 24A to 24C show that the resonance frequency shifts to be lower as the line width w becomes larger even in the dual-band antenna of FIGS. 23A and 23B. When attention is focused on the characteristics in the 2.4-GHz and 5-GHz bands, the antenna operating bandwidth becomes narrower as the line width w of the two conductors 2303 and 2304 becomes larger. That is, even in the structure of FIGS. 23A and 23B, coupling at the coupling portion becomes stronger as w becomes larger, similar to the structure of FIGS. 21A and 21B.

As described above, to adjust the coupling strength by the line width of the coupling portion, which is a feature of the dual-band antenna according to the fourth embodiment, it is only necessary to form the two conductors on the two surfaces of the dielectric substrate so that their coupling portions face each other. To obtain the same effects as those described above, for example, the positional relationship between the two second conductors 2103 and 2104 may be reversed in FIGS. 21A and 21B. More specifically, the feeding point 2101, first conductor 2102, and second conductor 2103 may be formed on the same surface of the dielectric substrate, and the other second conductor 2104 may be formed on a facing surface. Alternatively, in FIGS. 21A and 21B, only the coupling portions of the two conductors 2103 and 2104 may be formed on facing surfaces of the dielectric substrate.

In the dual-band antenna according to the fourth embodiment, the distance d between the conductors need not be a small value, unlike the structure described in the first embodiment. In the first embodiment, the distance d between the conductors determines the coupling strength and also determines the antenna operating frequency. Hence, an error of the distance d between the conductors sometimes influences the antenna characteristic. In the structure described in the first embodiment, for example, the value of the distance d between the conductors in the dual-band antenna shown in FIG. 2 is 0.1 mm. In some cases, the value of the distance d between the conductors becomes very small in order to adjust the strength of coupling between the conductors. To accurately ensure a short distance between the conductors, a high-accuracy manufacturing processing is necessary. However, in the dual-band antenna according to the fourth embodiment, the strength of coupling between the conductors can be adjusted by the line width w of the coupling portion. The coupling strength can therefore be adjusted by the line width w of the coupling portion without decreasing the value of the distance d between the conductors. The dual-band antenna according to the fourth embodiment can be manufactured relatively easily by a manufacturing process lower in accuracy than that for the dual-band antenna described in the first embodiment.

In the fourth embodiment, the coupling portions of the two conductors are formed on the two surfaces of the dielectric substrate. The effect of this dielectric substrate will be explained. As described in the first and second embodiments, the distance between the coupling portions of the two second conductors greatly influences the coupling strength. Also in the structure of the fourth embodiment, it is considered that the distance between the conductors influences the coupling strength and also influences the antenna characteristic. Hence, the dual-band antenna according to the fourth embodiment sometimes needs to have a structure capable of maintaining a predetermined distance between the conductors at the coupling portion.

When the conductor of the antenna is not formed on the dielectric substrate but, for example, configured in empty space, the conductor of the antenna does not have a structure for holding the shape. Thus, the conductor may be deformed owing to contact with the conductor in the manufacture, aging, or the like, and the distance between the conductors at the coupling portion where the influence on the antenna characteristic is serious may also change. However, when the coupling portions of the two conductors are formed on the two surfaces of the dielectric substrate, respectively, as in the fourth embodiment, the distance between the conductors at the coupling portion is maintained at the thickness of the dielectric substrate. For this reason, the number of factors which impair the antenna characteristic can be reduced, compared to the case in which no dielectric substrate exists.

The dielectric substrate has an effect of concentrating an electromagnetic field. When the coupling portions of the two conductors are formed on the two surfaces of the dielectric substrate, respectively, an electromagnetic field generated between the coupling portions becomes larger than that in the absence of the dielectric substrate. Since the electromagnetic field is concentrated at the coupling portions of the two conductors, the dual-band antenna according to the fourth embodiment can strengthen coupling generated between the two conductors serving as coupling portions, compared to the case in which no dielectric substrate exists. Since the coupling can be strengthened without increasing the line width of the conductor, the dual-band antenna according to the fourth embodiment can be further downsized in comparison with the case in which no dielectric substrate exists.

The antenna can be fabricated on the dielectric substrate by removing a conductor from each layer of a wireless module substrate to ensure an antenna region, and printing in the antenna region. This facilitates the fabrication of the above-described antenna, and the antenna can be manufactured at lower cost, compared to an antenna configured by folding a metal plate. Since the thickness of the antenna formed on the dielectric substrate is equal to that of the dielectric substrate, the whole antenna does not require a thickness larger than that of the dielectric substrate. The above-described structure enables forming an antenna on a dielectric substrate which forms a wireless module substrate, without making the antenna thicker than the dielectric substrate. A structure in which the antenna hardly projects can be implemented.

The above-described embodiment has explained a case in which the two second conductors having coupling portions are formed on the two surfaces of the dielectric substrate, respectively. However, the present invention is not limited to this. For example, when the dielectric substrate has a multilayer structure, the same effects as those described above can be obtained by forming the coupling portions of the two conductors on separate layers. That is, the coupling portions of the two conductors suffice to face each other, and they may be formed not on the two surfaces of the dielectric substrate but on separate layers on which they can face each other. In this case, a multi-band antenna which operates in a larger number of operating frequency bands can be implemented by increasing the number of antenna conductors, similar to the first embodiment. The same effects as those described above can be obtained by forming the coupling portions of the respective conductors on separate layers of the dielectric substrate having a multilayer structure, and coupling them, as needed. The line widths of the two conductors having coupling portions are equal in the above-described embodiment, but may be different.

In the above-described embodiment, the two conductors having coupling portions overlap each other when viewed from a direction perpendicular to the substrate surface, but may not overlap each other as long as coupling occurs. For example, the coupling portions of the two conductors may be twisted. It is also possible that the coupling portions of the two conductors partially overlap each other and the remaining portions do not overlap each other.

Even in the structure described in the fourth embodiment, the conductor may be formed into the meander line shape, similar to the second embodiment. Even in the structure described in the fourth embodiment, the dielectric sheet and dielectric substance may be adhered or brought close to each other to adjust the antenna operating frequency, similar to the third embodiment.

In a structure in which the surface of the antenna ground and the conductor of the antenna overlap each other when viewed from a direction perpendicular to the surface of the dielectric substrate, an emitted electromagnetic wave may be blocked by the surface of the antenna ground to attenuate the strength in a direction in which the electromagnetic wave travels from the conductor of the antenna to the surface of the antenna ground. When the wireless communication function is mounted in an electronic device, the location where a facing device communicating with the electronic device exists is not always constant. Thus, if the strength of an electromagnetic wave greatly weakens depending on the direction, it may become difficult to communicate with the facing device. However, the antenna according to the fourth embodiment has an antenna structure in which the surface of the antenna ground and the conductor of the antenna do not overlap each other. An electromagnetic wave emitted from the antenna can be emitted uniformly regardless of the direction.

The present invention can provide a compact multi-band antenna capable of easily satisfying the operating frequency requirement.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-176372 filed on Aug. 8, 2012, and 2013-105627 filed on May 17, 2013, which are hereby incorporated by reference herein in their entirety.

What is claimed is:

1. A multi-band antenna which operates in a plurality of frequency bands, comprising:

a feeding point;

a first conductor which is connected to said feeding point; and at least two second conductors which are branched from said first conductor, have a linear shape, and include open ends as ends on a side opposite to said first conductor, wherein the open ends of said second conductors face in substantially the same direction substantially parallel to a side closest to said feeding point out of sides of a region where the antenna is formed, said second conductors include a part at which a distance between said conductors at a portion parallel to the side is a first distance, and another part at which the distance is a second distance shorter than the first distance, and said second conductors are electromagnetically coupled at at least the other part, the other parts of each of the last two conductors are arranged on different flat surfaces.

2. The antenna according to claim 1, wherein said second conductors have different lengths and have different operating frequencies at which said two second conductors contribute.

3. The antenna according to claim 2, wherein the operating frequency of one of said second conductors is a 2.4-GHz band, and the operating frequency of said other second conductor is a 5-GHz band.

4. The antenna according to claim 2, wherein a sum of a length of one of said second conductors and a length of said first conductor is smaller than ¼ of a wavelength at the operating frequency at which said one of second conductors contributes.

5. The antenna according to claim 2, wherein the open end of one of said second conductors for which the contributory operating frequency is to be decreased is included as the other part.

6. The antenna according to claim 1, wherein at least one of said at least two second conductors has a meander line shape.

7. The antenna according to claim 1, wherein the multi-band antenna is formed on a flat surface.

8. The antenna according to claim 1, wherein the different flat surfaces include a first flat surface and a second flat surface, the first flat surface is a front surface of a substrate on which the multi-band antenna is formed, and the second flat surface is a back surface of the substrate.

9. The antenna according to claim 8, wherein the substrate includes a dielectric substrate.

10. The antenna according to claim 1, further comprising a dielectric substance which has a relative dielectric constant of larger than 1, and is arranged and added in contact with or at a predetermined distance from the multi-band antenna.

11. The antenna according to claim 10, wherein the dielectric substance includes a dielectric sheet, and is adhered to the entire multi-band antenna.

12. The antenna according to claim 10, wherein the dielectric substance is arranged and added in contact with or at a predetermined distance from only one of said two second conductors for which an operating frequency is to be shifted to be low.

13. The antenna according to claim 1, wherein antenna ground is arranged to set a distance between at least one of the open ends of said second conductors and the antenna ground to be not larger than a predetermined length.

* * * * *